US006781621B1

(12) United States Patent
Gobush et al.

(10) Patent No.: US 6,781,621 B1
(45) Date of Patent: Aug. 24, 2004

(54) LAUNCH MONITOR SYSTEM WITH A CALIBRATION FIXTURE AND A METHOD FOR USE THEREOF

(75) Inventors: William Gobush, North Dartmouth, MA (US); Diane I. Pelletier, Fairhaven, MA (US); Douglas C. Winfield, Mattapoisett, MA (US); Charles Days, South Dartmouth, MA (US); Steven Aoyama, Marion, MA (US); Edmund A. Hebert, Fairhaven, MA (US); James Alan Silveira, Bristol, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/537,295

(22) Filed: Mar. 29, 2000

Related U.S. Application Data

(63) Continuation-in-part of application No. 09/156,611, filed on Sep. 18, 1998.

(51) Int. Cl.[7] ..... A63B 69/36

(52) U.S. Cl. ..... 348/157; 348/135; 473/198

(58) Field of Search ..... 348/61, 169–172, 348/77, 78, 135–140, 157, 189

(56) References Cited

U.S. PATENT DOCUMENTS

| | | | | |
|---|---|---|---|---|
| 3,513,707 | A | 5/1970 | Russell et al. | |
| 3,630,601 | A | 12/1971 | Lehovec | |
| 3,918,073 | A | 11/1975 | Henderson et al. | |
| 4,063,259 | A | 12/1977 | Lynch et al. | |
| 4,136,387 | A | 1/1979 | Sullivan et al. | |
| 4,137,566 | A | 1/1979 | Hass et al. | |
| 4,158,853 | A | 6/1979 | Sullivan et al. | |
| 4,160,942 | A | 7/1979 | Lynch et al. | |
| 4,375,887 | A | 3/1983 | Lynch et al. | |
| 4,418,773 | A | * 12/1983 | Finet et al. | 177/16 |

(List continued on next page.)

OTHER PUBLICATIONS

Science and Golf, 1st Edition, Jul., 1990, Chiraraishi et al., "A new method on measurement of trajectories of a golf ball" pp. 193–198.

Science and Golf, 1st Edition, S. Aoyama, Jul. 1990,"A modern method for the measurement of aerodynamic lift and drag on golf balls," pp. 199–204.

Science and Golf II, 1st Edition, Jul. 1994, Gobush et al., "Video Monitoring System to Measure Initial Launch Characteristics of Golf Ball," Ch. 50, pp. 327–333.

Scientific American, Jan. 1997, Mion et al., "Tackling Turbulence with Supercomputers," pp. 62–68.

The Wall Street Journal, Nov. 1997, Bill Richards, "Why It Takes a Rocket Scientist to design a Golf Ball," pp. B1 and B11.

*Primary Examiner*—Chris Kelley
*Assistant Examiner*—George Bugg, Jr.
(74) *Attorney, Agent, or Firm*—Swidler Berlin Shereff Friedman, LLP

(57) ABSTRACT

The present invention is directed to a launch monitor system that measures flight characteristics of an object moving in a predetermined field-of-view. The system includes a support structure, a lighting unit, a camera unit disposed on the support structure, and a calibration assembly. The calibration assembly includes a calibration fixture and at least one telescoping member. A first end of the telescoping member is coupled to the support structure and a second end is contactable with or coupled to the fixture. In an extended position of the telescoping member, the calibration fixture is in the field-of-view of the camera unit. In a retracted position, the calibration fixture out of the field-of-view. The calibration fixture further includes contrasting markings. In another embodiment, the system includes a frame and the launch monitor is pivotally suspended from the frame so that it self-levels. The present invention further includes a method of calibrating a launch monitor having a calibration fixture.

14 Claims, 22 Drawing Sheets

U.S. PATENT DOCUMENTS

| | | | | | |
|---|---|---|---|---|---|
| 4,461,477 | A | | 7/1984 | Stewart | |
| 4,477,079 | A | | 10/1984 | White | |
| 4,695,888 | A | | 9/1987 | Peterson | |
| 4,695,891 | A | | 9/1987 | Peterson | |
| 4,713,686 | A | | 12/1987 | Ozaki et al. | |
| 4,858,934 | A | | 8/1989 | Ladick et al. | |
| 4,893,182 | A | | 1/1990 | Gautraud et al. | |
| 5,101,268 | A | | 3/1992 | Ohba | |
| 5,111,410 | A | | 5/1992 | Nakayama et al. | |
| 5,179,441 | A | | 1/1993 | Anderson et al. | |
| 5,210,603 | A | | 5/1993 | Sabin | |
| 5,297,796 | A | | 3/1994 | Peterson | |
| 5,342,054 | A | | 8/1994 | Chang et al. | |
| 5,471,383 | A | | 11/1995 | Gobush et al. | |
| 5,482,284 | A | * | 1/1996 | Vandever | 473/218 |
| 5,501,463 | A | | 3/1996 | Gobush et al. | |
| 5,575,719 | A | | 11/1996 | Gobush et al. | |
| 5,589,628 | A | | 12/1996 | Braly | |
| 5,696,837 | A | * | 12/1997 | Green | 382/128 |
| 5,718,639 | A | * | 2/1998 | Bouton | 473/151 |
| 5,803,823 | A | | 9/1998 | Gobush et al. | |
| 5,833,549 | A | * | 11/1998 | Zur et al. | 473/199 |
| 5,841,541 | A | * | 11/1998 | Dlugos | 356/634 |
| 5,907,819 | A | * | 5/1999 | Johnson | 702/152 |
| 5,988,861 | A | * | 11/1999 | Baum | 702/142 |

* cited by examiner

LAUNCH MONITOR SYSTEM WITH A CALIBRATION FIXTURE AND A METHOD FOR USE THEREOF

This application is a continuation-in-part application of U.S. application Ser. No. 09/156,611 filed on Sep. 18, 1998, now pending, which is incorporated herein by reference in its entirety.

TECHNICAL FIELD OF THE INVENTION

The present invention relates to sports objects, and more particularly relates to an improved launch monitor system for analyzing sports objects, and a method for the use thereof. The launch monitor system includes a calibration fixture.

BACKGROUND OF THE INVENTION

Apparatus for measuring golf ball flight characteristics and club head swing characteristics are known. The golf ball or golf club head is marked with at least one contrasting area. The apparatus uses the contrasting area(s) to determine the characteristics.

One particularly troublesome aspect of past systems for measuring golf balls and clubs is calibration of the system. Improvements related to increased ease and speed of calibration are desirable. It is further desired that the calibration not hinder the portability of the apparatus. The apparatus should be easily movable to the most desirable teaching or club fitting locations, e.g., on an outdoor driving range or golf course fairway. In addition, the apparatus should be easily movable to various locations on the range or fairway. Furthermore, it is desirable to provide a method for calibrating such an apparatus that is fast, easy and accurate.

SUMMARY OF THE INVENTION

Broadly, the present invention comprises a launch monitor system with an improved calibration fixture and a method for use thereof.

The launch monitor system can measure the flight characteristics of an object moving in a predetermined field-of-view. The object is, for example, a golf ball and/or a golf club, or the like. The launch monitor system includes a support structure, a lighting unit, a first camera unit, and a calibration assembly. The lighting unit is disposed on the support structure and directs light into the predetermined field-of-view. The first camera unit is disposed on the support structure and pointed toward the predetermined field-of-view. The calibration assembly includes a calibration fixture and at least one telescoping member. A first end of the telescoping member is coupled to the support structure and a second end of the telescoping member is contactable with or coupled to the calibration fixture. The telescoping member has an extended position that places the calibration fixture in the field-of-view of the camera unit. The telescoping member has a retracted position where the calibration fixture is out of the field-of-view of the camera unit.

In one embodiment, the calibration fixture includes contrasting areas or markings in at least two different planes, and more preferably three different planes. The contrasting markings are for example, reflective markings, retro-reflective dots, or painted markings.

In another embodiment, the launch monitor system further includes a second camera unit disposed on the support structure and pointed toward the predetermined field-of-view, and the telescoping member is disposed between the first camera unit and the second camera unit.

In yet another embodiment, the launch monitor system further includes a computer with at least one algorithm, and each camera takes at least one image of the calibration fixture and the computer converts each image into calibration data.

The present invention is also directed to a launch monitor system that includes a frame, a launch monitor for taking at least one image of the object of the field-of-view. The launch monitor is pivotally coupled to the frame at a pivot point such that the launch monitor is spaced above a surface and the pivot point is aligned above the center of the monitor. Thus, the launch monitor is free to move with respect to the surface and self-level. The launch monitor system, in one embodiment, further includes a calibration fixture with contrasting markings thereon.

In yet another embodiment, the present invention is directed to a method of calibrating a launch monitor having a calibration fixture, comprising the steps of: providing the launch monitor with a telescoping member; moving the telescoping member from a retracted position to an extended position; contacting the calibration fixture to the free end of the telescoping member in at least the extended position; taking at least one image of the fixture while the telescoping member is in the extended position; converting each image into calibration data; and determining launch monitor constants based on the calibration data.

DESCRIPTION OF THE PREFERRED EMBODIMENT

Figure 1:
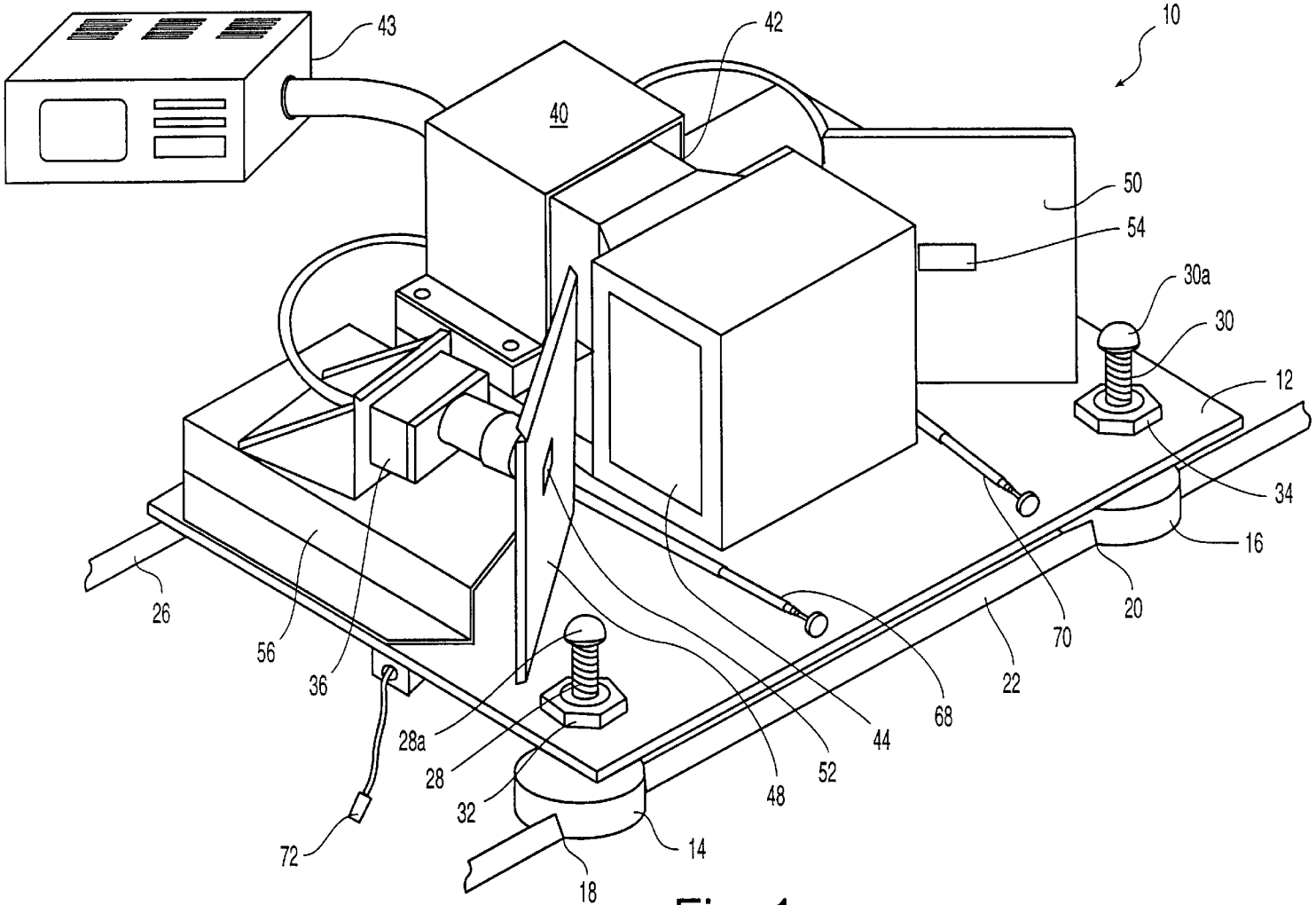
FIG. 1 is a perspective view of a first embodiment of a launch monitor of the present invention.

FIG. 1 illustrates a preferred first embodiment of the invention in the form of a portable launch monitoring system 10 including a base or support structure 12 and attached support elements 14, 16. Support elements 14, 16 are specifically shown as slide pads each including V-shaped notches 18, 20, which allow the pads 14, 16 to slide along a rod 22. Another slide pad 24 attached to the system 10 at the rear (shown in FIG. 3) similarly slides along a rod 26. One or more slide pads 14, 16, and 24 may be replaced by other support elements with different configurations or methods of moving, such as wheels. By the term "slide pads," applicants intend to cover any elements allowing the system 10 to slide or move back and forth relative to a predetermined field-of-view. Slide pads 14, 16 include a height adjustment feature allowing the front corners of system 10 to be raised or lowered for leveling purposes. Specifically, each slide pad 14, 16 is attached to support structure 12 by respective threaded rods 28, 30 and nuts 32, 34 fixed to the support structure 12. Rods 28, 30 each include a drive portion 28*a*, 30*a* that may be used to adjust pads 14, 16.

Figure 2:
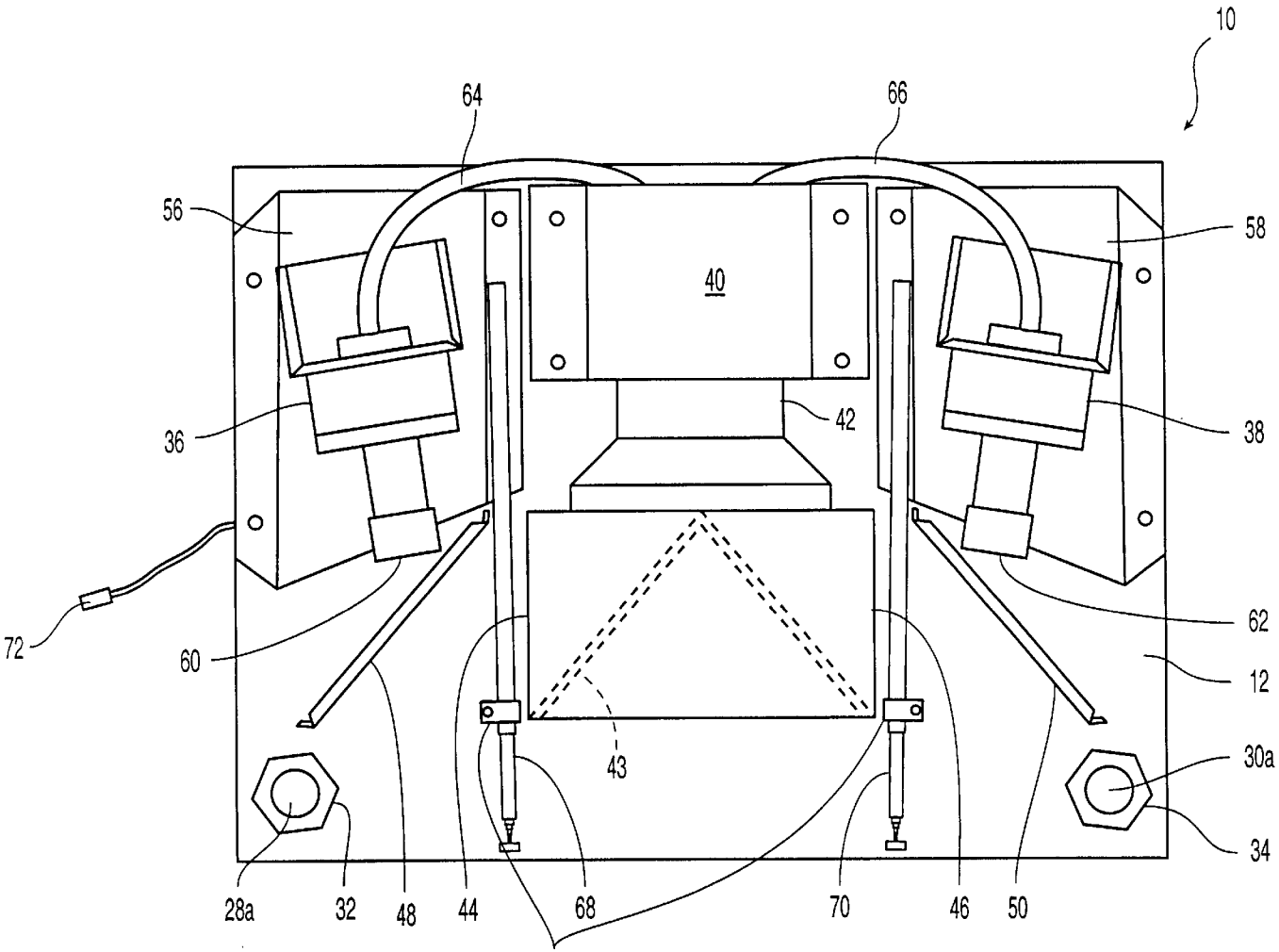
FIG. 2 is a top view thereof.
Figure 3:
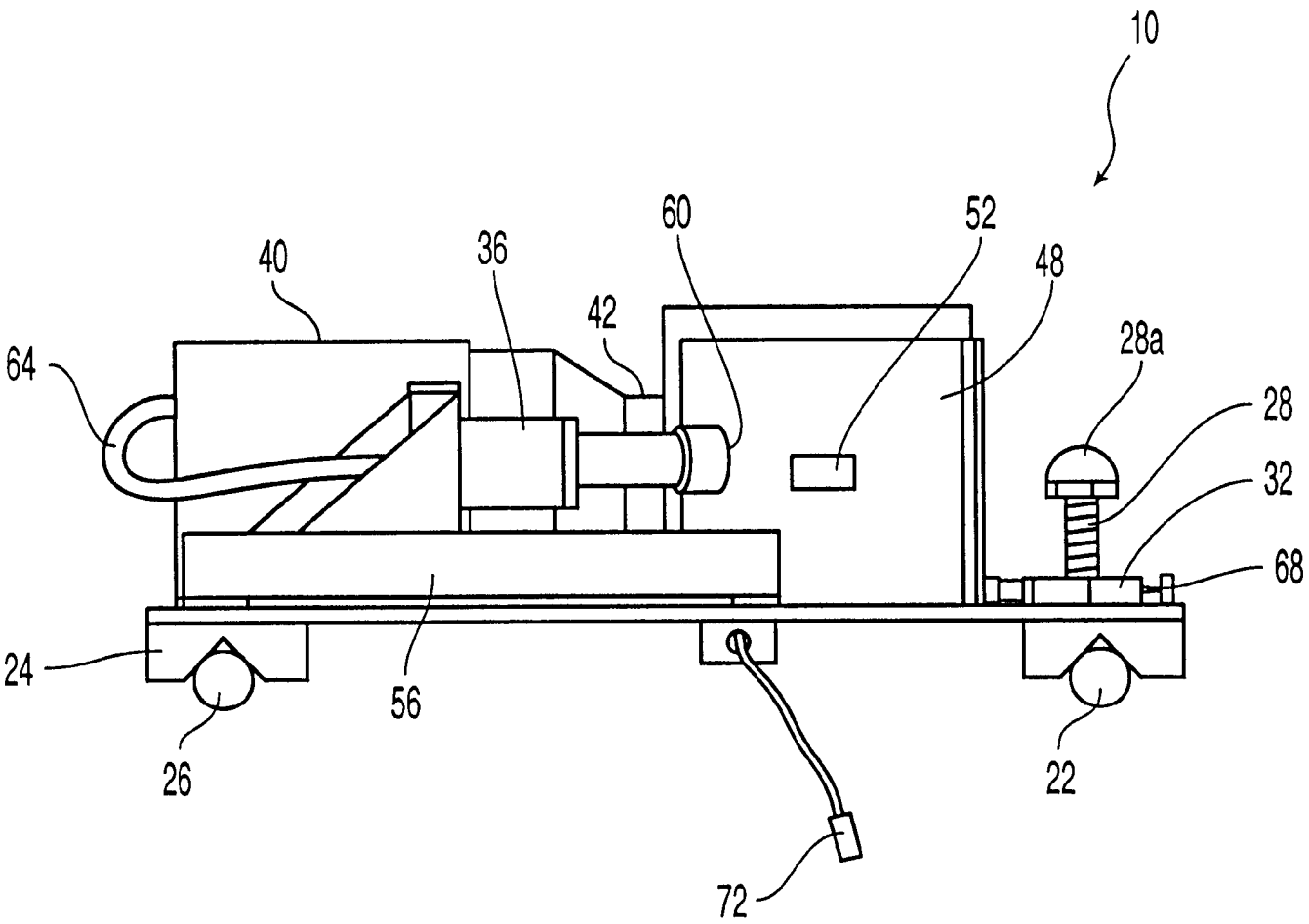
FIG. 3 is a side elevational view of the monitor shown in FIGS. 1 and 2.
Figure 4:
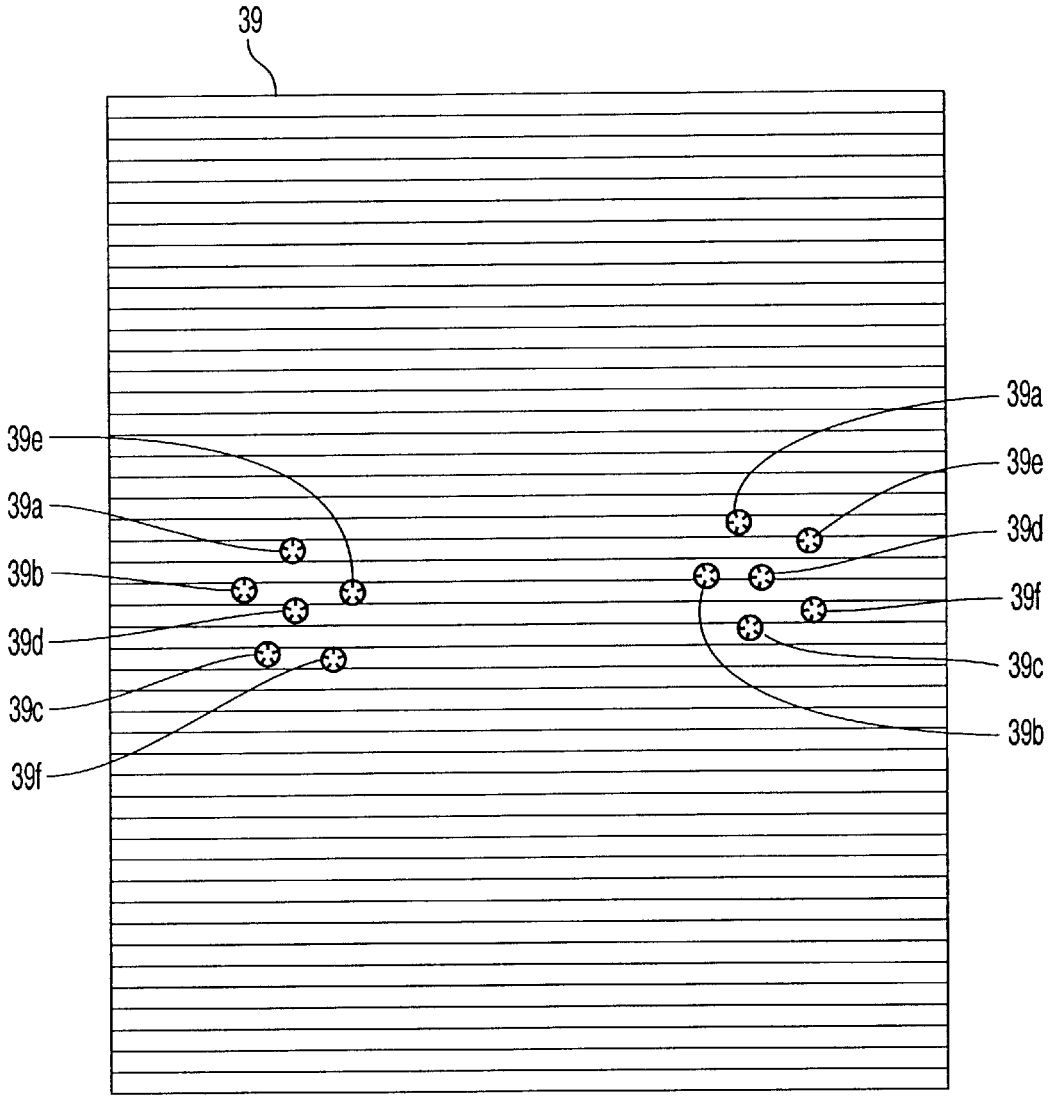
FIG. 4 is an elevational view of the light receiving and sensory grid panel located in each camera within the monitor.

Referring now to FIGS. 1–3, launch monitoring system 10 further includes first and second camera units 36, 38, a centrally disposed control box 40, and a dual strobe lighting unit 42. First and second camera units 36, 38 are preferably ELECTRIM EDC-1000U Computer Cameras from Electrim Corporation in Princeton, N.J. Charge coupled device or CCD cameras are preferred but TV-type video cameras are also useful. The angle between the two cameras' line of sight is preferably in the range of about 10°–about 30°, with about 22° being most preferable. Each of the cameras 36, 38 has a light-receiving aperture, shutter, and light sensitive silicon panel 39 (see FIG. 4, showing a silicon panel, which also generally corresponds to an image captured by the cameras and used by the system). The cameras are directed and focused on a predetermined field-of-view in which a golf ball moves and is imaged.

Figure 5:
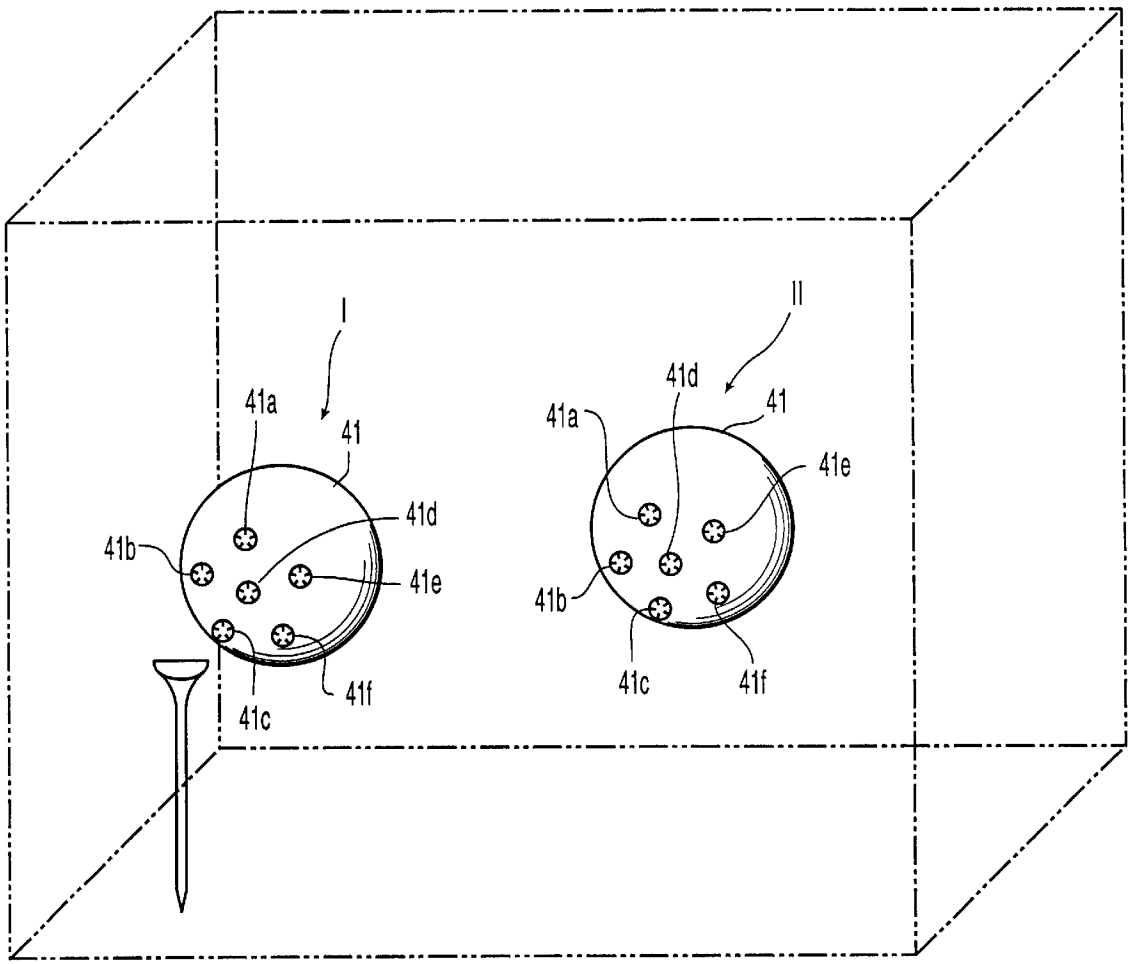
FIG. 5 is a perspective view of a three-dimensional rectilinear field showing a golf ball at two different positions I and II.

As shown in a three-dimensional, predetermined, rectilinear field-of-view (shown in phantom) in FIG. 5, golf ball 41 preferably has six (6) reflective, spaced-apart round areas or dots 41*a–f* placed thereon. Golf ball 41 is shown in two positions I and II to illustrate the preferred embodiment, corresponding to the locations of the golf ball 41 when imaged by the system. In positions I and II the golf ball is shown after being struck. The image taken at position I occurs at a first time and occurs at in position II at a second time. The preferred diameters of the round dots 41*a–f* range from one-tenth (1/10) to one-eighth (1/8) of an inch, but other sized and shaped areas can be used. Dots 41*a–f* are preferably made of reflective material which is adhered to the golf ball. The Scotchlite™ brand beaded material made by Minnesota Mining and Manufacturing (3M) is preferred for forming the dots. Corner-reflective retro-reflectors may also be used. Alternatively, painted spots can be used that define contrasting areas. At least one dot or contrasting area is used for the golf ball. Preferably, the number of dots or areas is as few as three (3) and up to six (6). However, more than t dots can also be used, provided each dot or area reflects light from the golf ball in both positions shown in FIG. 5. As a result of the positioning of the cameras 36, 38 and the dots 41*a–f*, both cameras 36 and 38 are capable of receiving light reflected by dots 41*a–f*, which appear as bright areas 39*a–f* on the silicon panel 39 (as shown in FIG. 4) and the corresponding image. Alternatively, the dots may be non-reflective, appearing as dark areas 39*a–f* on the silicon panel.

Reflective materials as compared with the coated surface of the golf ball can be as high as nine hundred (900) times brighter where the divergence angle between the beam of light striking the dots 41*a–f* and the beam of light from such dots to the camera aperture is zero or close to zero. As the divergence angle increases, the ratio of brightness of such dots 41*a–f* to the background decreases. It will be appreciated that electromagnetic waves outside the range of visible light, such as infra red light, may be used to make the flash light invisible to the golfer.

The control box 40 communicates via an asynchronous protocol via a computer's parallel port to the camera units 36, 38 to control their activation and the dual strobe lighting unit 42 to set off the successive flashes. Dual strobe lighting unit 42 includes two Vivitar Automatic Electronic Flash Model 283 strobe lights mounted on top of one another. These strobe lights sequentially direct light onto a beam splitter 43 and then out of the unit through windows 44 and 46 to reflective elements or panels 48, 50 and then to the predetermined field-of-view. Panels 48, 50 may be plates formed of polished metal, such as stainless steel or chrome-plated metal. Other light reflective elements may also be used without departing from the spirit or scope of the invention. Each reflective panel 48, 50 includes an aperture 52, 54. Cameras 36, 38 are fixed on support structure 56, 58 and are thereby disposed with their respective lenses 60, 62 directed to the predetermined field-of-view through apertures 52, 54. Video lines 64, 66 feed the video signals into control box 40 for subsequent use.

The locations of the strobe lights, beam splitter, reflective elements and cameras allow the light directed from the strobe to enter the field-of-view and be reflected back from the ball, due to the reflective dots, to the camera lenses through the apertures. In another embodiment, ring-shaped strobe lights can be used which surround each camera lens. Since the ring-shaped strobe lights are positioned close to the lenses and the center axis of the strobe is aligned with the center of the lenses, the light once reflected off the markers would enter the lenses. Thus, eliminating the need for the reflective elements.

Preferably, telescoping distance calibrators 68, 70 are affixed to support structure 12 via brackets and fasteners 71.

The telescoping members are used in calibrating launch monitoring system 10 at the appropriate distance from an object to be monitored. Distance calibrators 68, 70 are extendable members for example conventional radio antennae can be used. Calibrators 68, 70 are used in conjunction with a calibration fixture shown in FIG. 11 and discussed in detail below with respect to the second embodiment. It will be understood that the same calibration fixture is preferably used with both the first and second embodiments. At least one distance calibrator should be used.

In this first embodiment, a microphone 72 is used to begin the operation of the system 10. When the golf club hits the golf ball, a first image of the golf ball 41 in the predetermined field-of-view is taken, as shown in FIG. 5 position I, in response to the sound being transmitted by the microphone 72 to the system 10. Since the system 10 is preferably used to monitor only the golf ball, although it could also be used to monitor the golf club, the first of the two images needs only to be taken once the golf ball is struck by the club, as illustrated by the golf ball in position I of FIG. 5. A laser or other apparatus (not shown) can also be used to initiate the system. For example, the initiating means can include a light beam and a sensor. When the moving golf ball passes through the light beam the sensor sends a signal to the system. When the laser is used, the laser is arranged such that a golf club breaks the laser beam just after (or at the time) of contact with the golf ball. That is, the laser is aligned directly in front of the teed golf ball and the first image taken as or shortly after the golf ball leaves the tee. The operation of the first embodiment is discussed in detail below after a description of the second embodiment.

FIGS. 6–10 illustrate a second embodiment of the present invention that further reduces the size and therefore increases the portability of the system.

Figure 7:
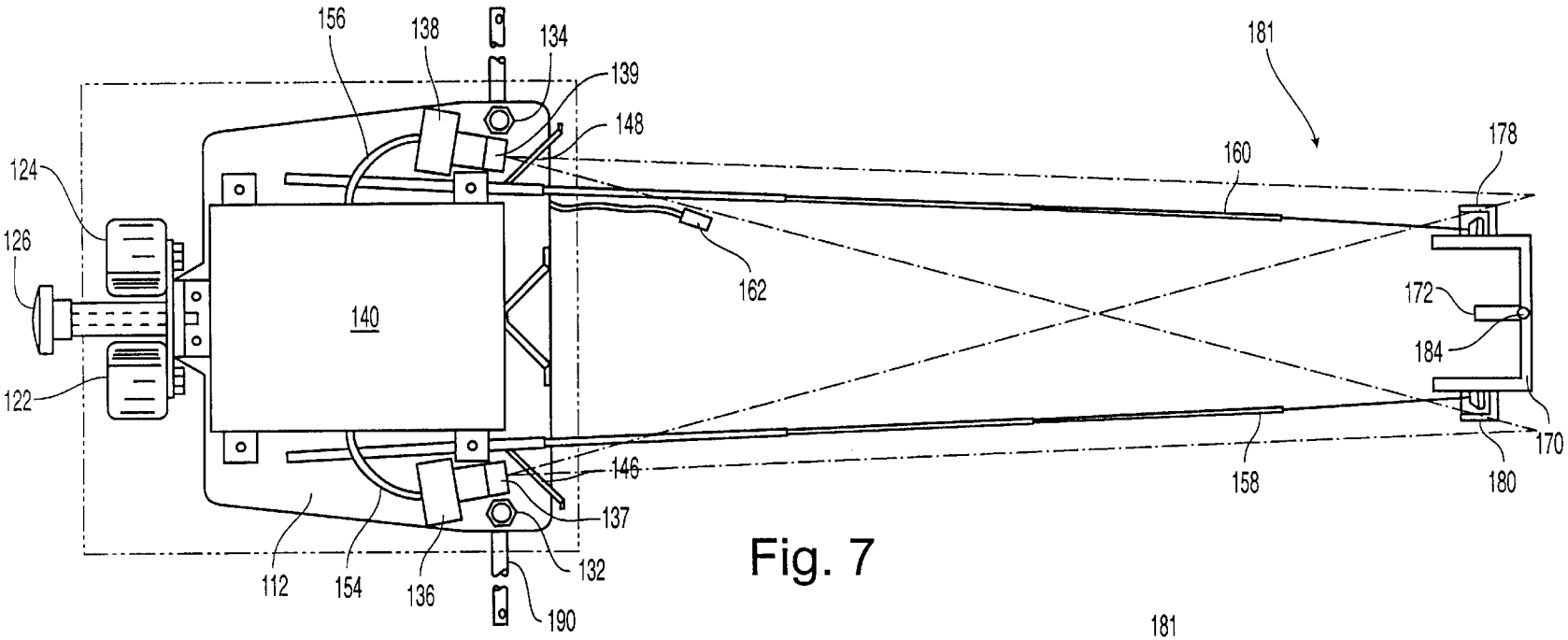
FIG. 7 is a top view of the monitor shown in FIG. 6 and generally showing calibration of the system.
Figure 8:
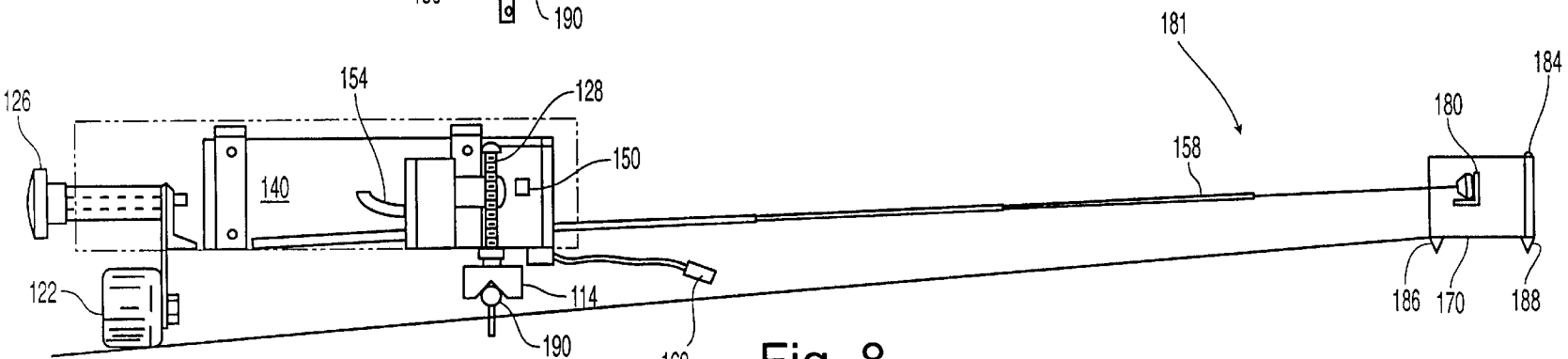
FIG. 8 is a side elevational view of the monitor shown in FIGS. 6 and 7.

Launch monitoring system 100 includes a base or support structure 112 that may also have a cover 113. Slide members or pads 114, 116 are utilized at a lower front portion of support structure 112 and include notches 118, 120 for receiving a rod 190 along which pads 114, 116 may slide. As shown in FIGS. 7 and 8, wheels 122, 124 replace the pad 24 disclosed with respect to the first embodiment shown in FIGS. 1–3. Wheels 122, 124 are attached for rotation and to support structure that includes a handle 126 for allowing an operator to move launch monitoring system 100 back and forth along the ground. Like the first embodiment, this second embodiment also includes threaded rods 128, 130 and respective nuts 132, 134 for allowing height adjustment at the front of launch monitoring system 100. The wheels may also be height adjusted relative to the support 112 to allow the system 100 to be adjusted depending on the terrain on which the system is placed. Although not shown for the second embodiment, the systems in the first and second embodiments also have a computer and monitor 43 (as shown in FIG. 1). The computer and monitor may be combined into a single element or be separate elements. The computer has several algorithms and programs used by the system to make the determinations discussed below.

Figure 6:
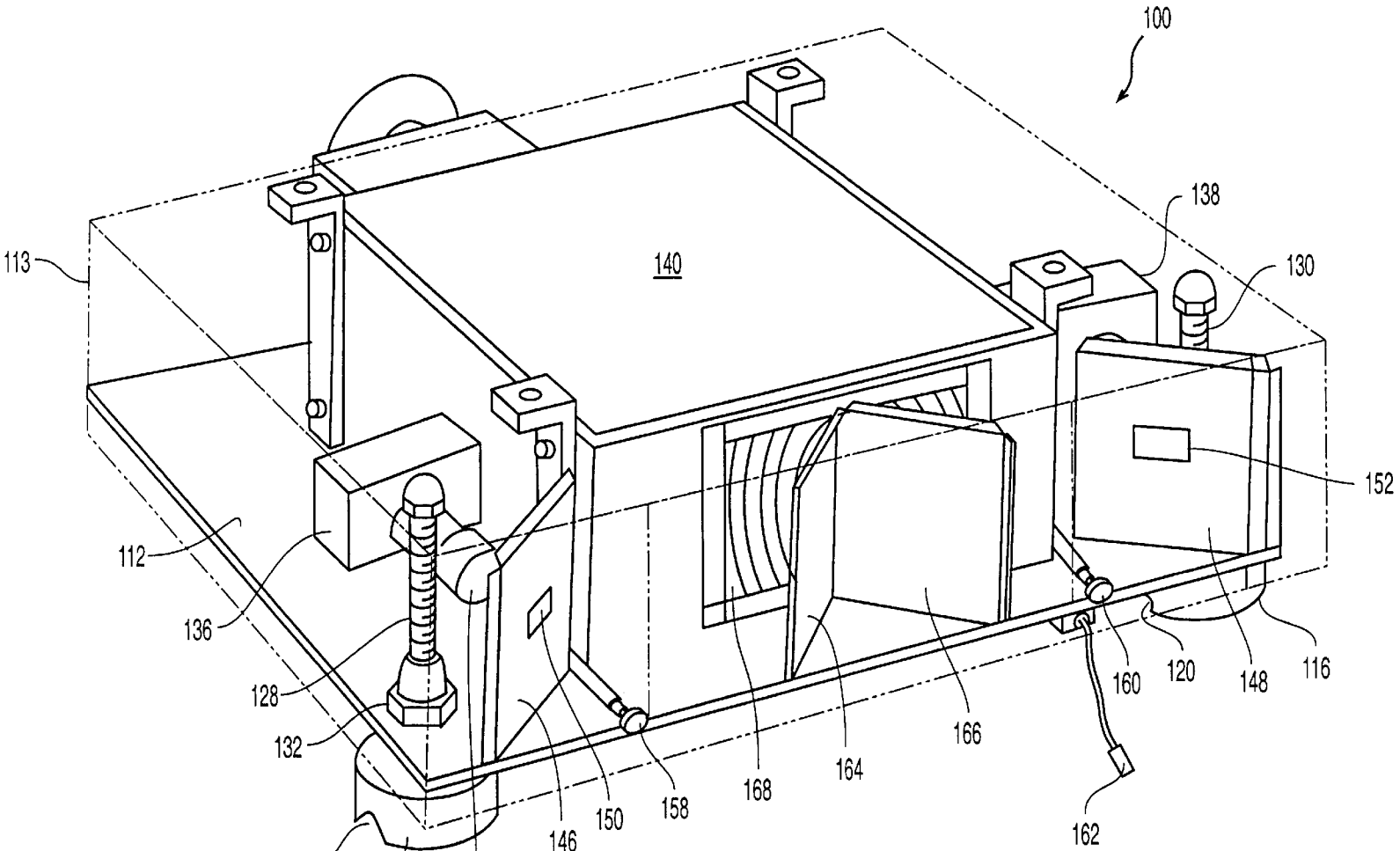
FIG. 6 is a perspective view of a second embodiment of a launch monitor of the present invention.
Figure 9:
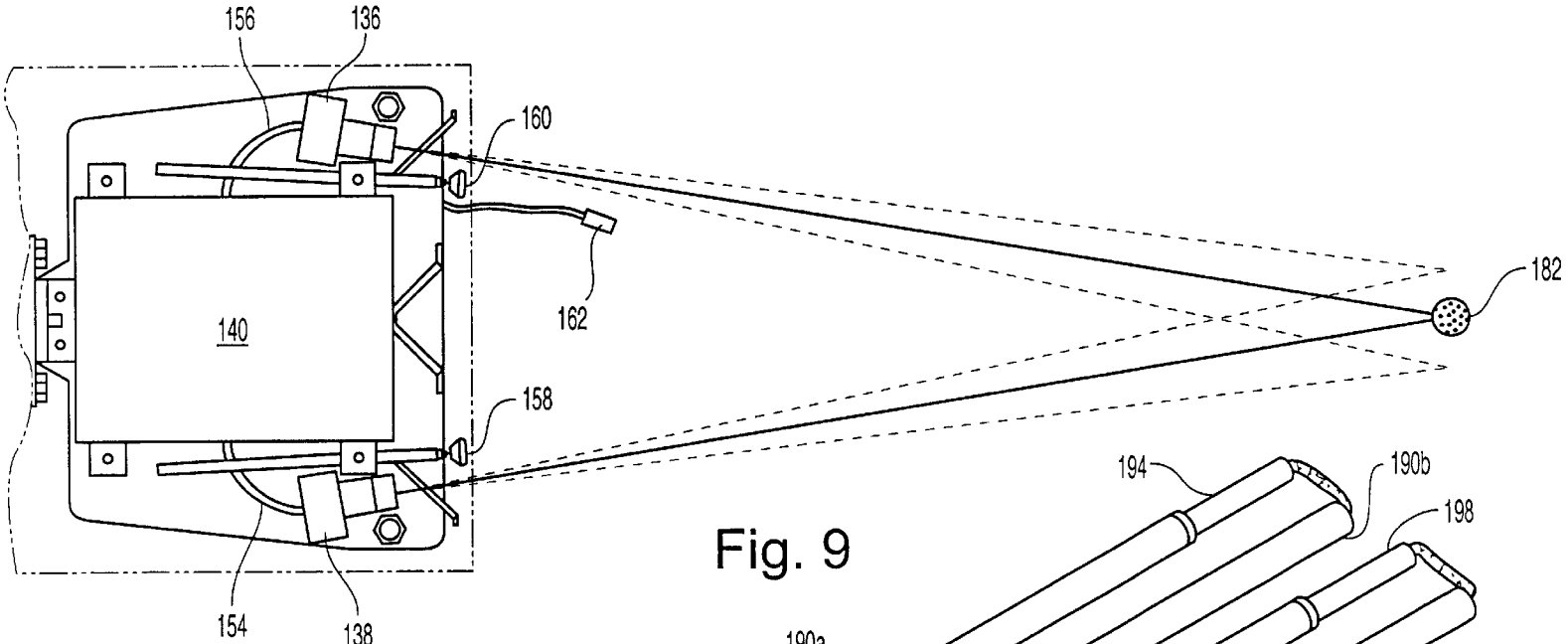
FIG. 9 is a top view of the monitor shown in FIGS. 6–8 and generally showing a golf ball in place under operating conditions.

As further shown in FIGS. 6 and 7, first and second camera units 136, 138 are affixed to support structure 112. These electro-optical units 136, 138 are smaller than those disclosed with respect to the first embodiment and are preferably the ELECTRIM EDC-1000HR Computer Cameras available from the Electrim Corporation in Princeton, N.J. The cameras also have light-sensitive silicon panels as in the first embodiment. The cameras 136, 138 each have a line-of-sight, which are illustrated as solid lines in FIG. 9, that are directed to and focused on the predetermined field-of-view. As illustrated in FIG. 9 with the broken lines, the cameras' fields-of-view are larger than are necessary to image just a single golf ball. Thus, the predetermined field-of-view is the cameras' fields-of-view at the location where the cameras' lines-of-sight intersect.

Figure 10:
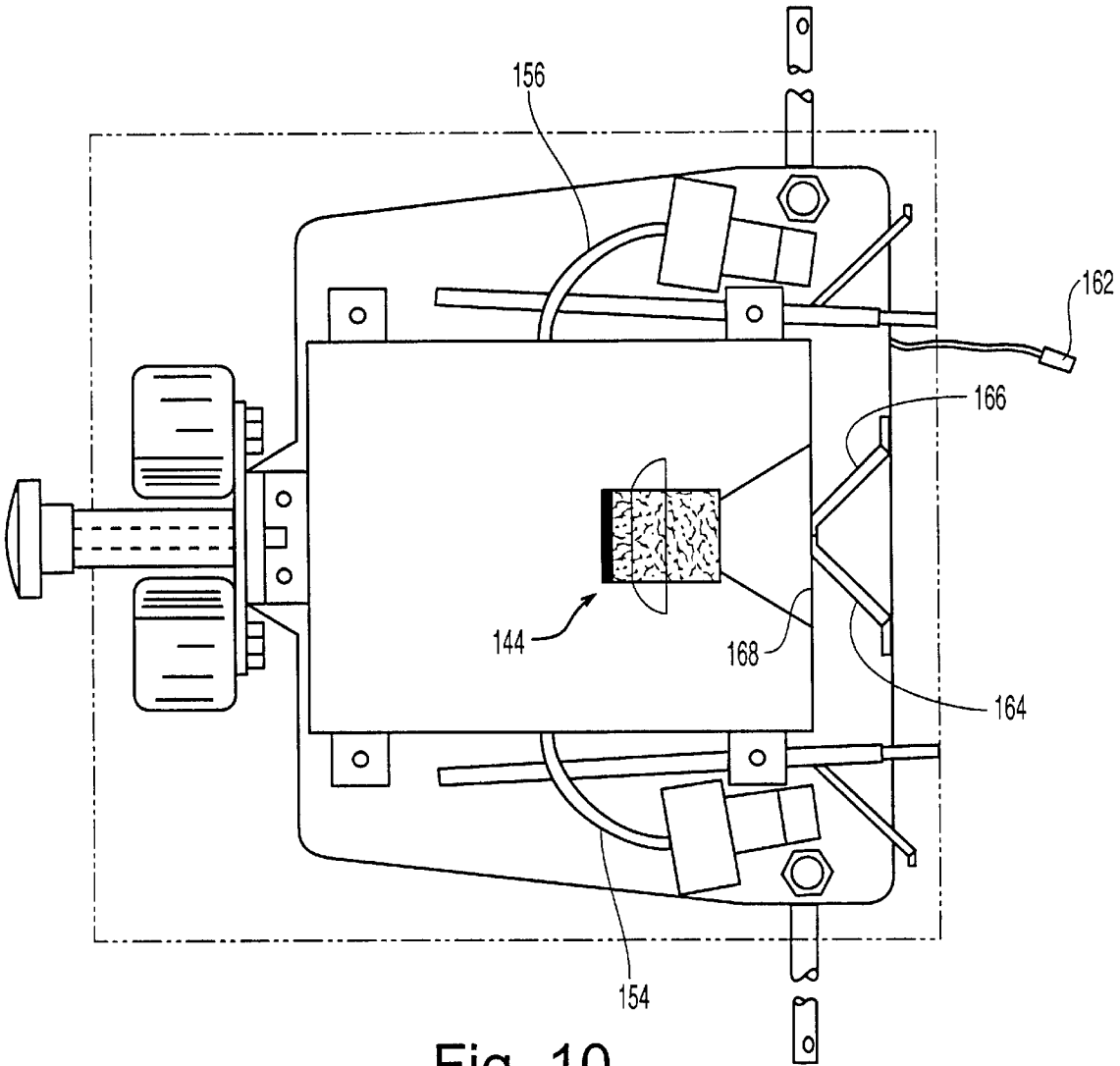
FIG. 10 is a partial, cut-away top view of the monitor shown in FIGS. 6–9 illustrating the strobe lighting unit.

A control box 140 is provided and includes a strobe light unit at a front portion thereof. As shown in FIG. 10, strobe light unit is comprised of a single flash bulb assembly 144, the related circuitry, and a cylindrical flash tube. The operation of which is described in more detail below. As best shown in FIG. 6, the reflective elements or panels 146, 148 are mounted to support structure 112 in a similar orientation to those discussed above with respect to the first embodiment. Reflective panels 146, 148 also include respective apertures 150, 152. Referring to FIGS. 6 and 7, cameras 136, 138 are mounted such that the lenses 137, 139 are directed through the respective apertures 150, 152 in the reflective panels 146, 148 to the predetermined field-of-view. Video lines 154, 156 from the respective electro-optical units 136, 138 lead to control box 140. Like the first embodiment, this embodiment includes distance calibrators also in the form of antenna 158, 160, and microphone 162 that also is used to initiate the operation of the system. Again, a laser or other method of initiating the system could be used.

Referring to FIG. 10, the increase in the portability of the second system 100 over the first system 10 is also due to the use of a single flash bulb assembly 144, and associated circuitry in the strobe light unit. The strobe light unit has a single flash bulb assembly 144 capable of flashing faster than every 1000 microseconds. The circuits used with the strobe light unit are the subject of another commonly assigned application (application Ser. No. 09/008,588), which is incorporated herein in its entirety by express reference thereto. A diagram of the circuit used for the strobe light unit is illustrated in FIGS. 11A and 11B. As there is only a single flash bulb in the strobe light unit, it will be appreciated that two additional reflective elements are required. Referring to FIG. 6, a third light-reflecting panel 164 reflects about one-half of the light from flash bulb into panel 146 while a fourth light-reflecting panel 166 reflects the other half of the light into light-reflecting panel 148. The respective set-ups for both the calibration mode and the operation mode of system 100 are shown in FIGS. 7–8 and 9, respectively.

Referring to FIG. 10, to increase the amount of light directed to the reflective elements or panels 146, 148, 164, and 166, the system 100 preferably has an optical or Fresnel lens 168 inserted at the front of the control box 140, placed between the flash bulb assembly 144 and the third and fourth reflective elements or panels 164, 166. A lens assembly is formed by the lighting unit and the Fresnel lens. The Fresnel lens 168 directs light from the flash bulb assembly 144 to the third and fourth reflective elements 164, 168. The Fresnel lens has a collimating effect on the light from a cylindrical flash tube. Thus, light pattern with the Fresnel lens 168 controls the dispersion of light. The lens 168 preferably has a focal length of about 3 inches, and the center of the flash bulb assembly 144 is less than 3 inches behind the lens. This arrangement allows the system 100 to have a smaller flash bulb assembly 144 than without the lens 168 because the collimation of the light increases the flux of light at the golf ball in the predetermined field-of-view. This increase in the flux allows the possibility of using other reflective materials (or none at all), as well as the use of the system in brighter lighting conditions, including full-sun daylight.

Figure 11:
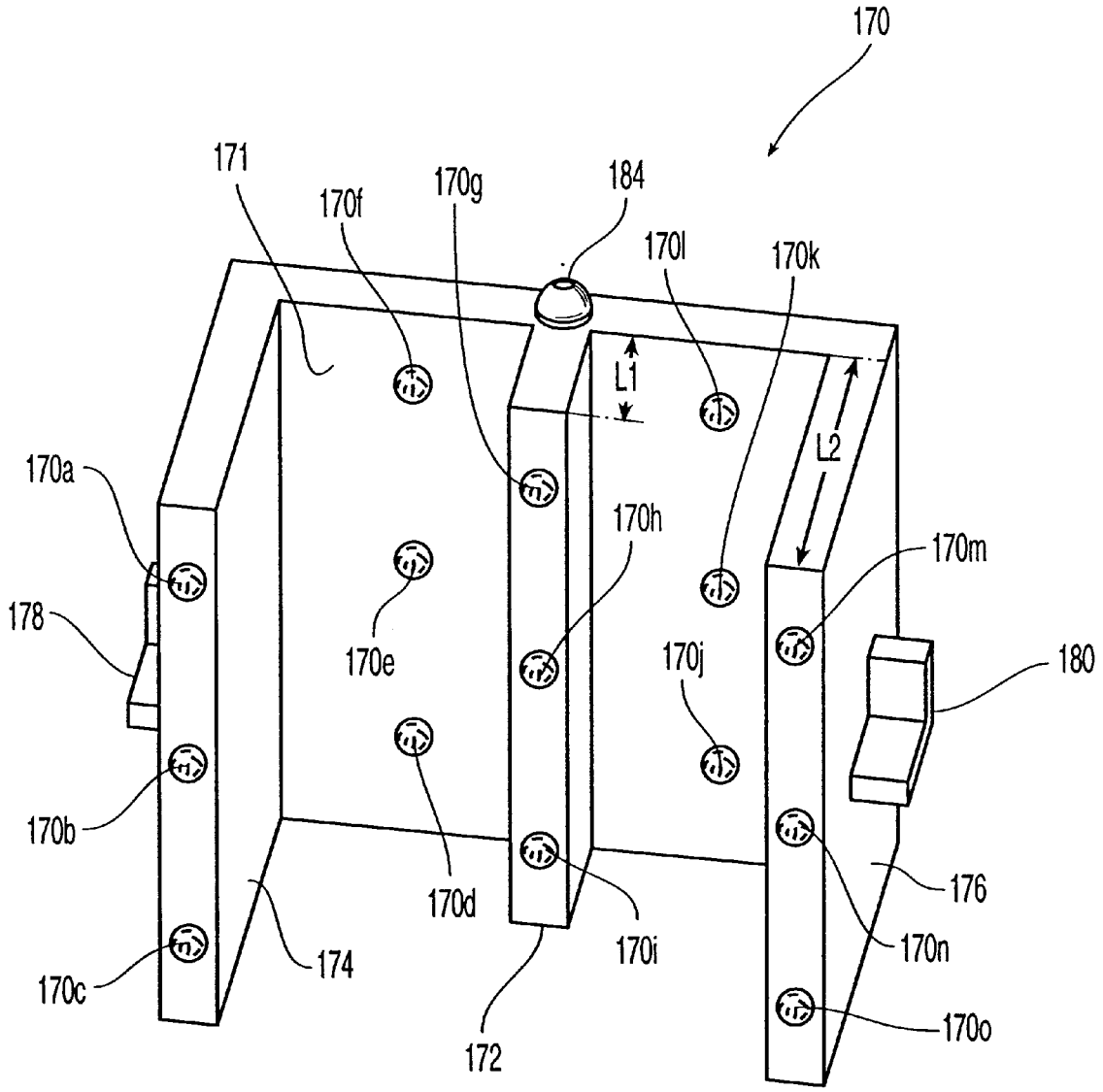
FIG. 11 is a perspective view of a first embodiment of a calibration fixture carrying fifteen illuminable areas.

A calibration fixture 170 (as shown in FIG. 11) is provided to calibrate the systems 10 and 100 shown in FIGS. 1 and 6.

Turning to FIGS. 7 and 8, the calibration fixture 170 is shown in use. Although this discussion is with reference to system 100, it applies equally to system 10. The fixture 170 includes a back wall 171, a central wall or leg 172 extending from the back wall 171, outer wall or legs 174 and 176 extend from the back wall 171 spaced from the central leg 172. The length of the central leg 172 from the front surface of the back wall 171 is designated as L1. The length of the outer legs 174 and 176 from the front surface of the back wall 171 is designated as L2. In this embodiment, the length L2 of the outer legs 174 and 176 is greater than the length of the central leg 172.

The outer legs 174 and 176 further include receiving elements or tabs 178, 180 that extend outwardly therefrom. As shown in FIGS. 7 and 8, the tabs 178, 180 receive an end portion of the distance calibrators 158, 160. With the distance calibrators 158, 160 in an extended position with the fixture 170 in contact therewith, the central leg 172 of fixture 170 is disposed at the proper location for a golf ball 182 used in a launch monitoring operation, as shown in FIG. 9. The distance calibrators and fixture form a calibration assembly 181. In this position, the calibration fixture 170 is positioned within the field of view of the cameras 136 and 138. Golf ball 182 also has at least one contrasting area or retro-reflective dot, and more preferably a pattern of retro-reflective dots similar to golf ball 41 (as shown in FIG. 5) in the first embodiment.

Referring to FIGS. 7, 8, and 10, calibration fixture 170 further includes an optical level indicator 184 on a top surface of the back wall 171 for allowing fixture 170 to be leveled before the calibration procedure. Spikes 186, 188 (as shown in FIG. 8) extending from the bottom of fixture 170 are inserted into the turf to stabilize fixture 170 during the calibration procedure. It will be appreciated that calibration fixture 170 and golf ball 182 are also preferably used with the first embodiment shown in FIGS. 1–3 in the same manner discussed here.

Referring to FIG. 11, fixture 170 has a pattern of contrasting areas or retro-reflective dots 170*a–o*. Applicants have found that only 15 dots (as opposed to the twenty dots used on the calibration fixture of application Ser. No. 08/751,447) are necessary. Since the longitudinal movement of the golf ball is greater than its vertical movement during the time between the two images (see, e.g., FIG. 4), the calibration of the system need not be as precise in the vertical direction. Therefore, fewer dots in the vertical direction on the calibration fixture are needed to adequately calibrate the system. The number of contrasting areas can be as low as six. Since the areas 170*a–o* are disposed on the back wall 171, free end of the central leg 172, and the free ends of the outer legs 174 and 176, the dots are located in three dimensions. However, the dots can also be located only within two dimensions.

Figure 9A:
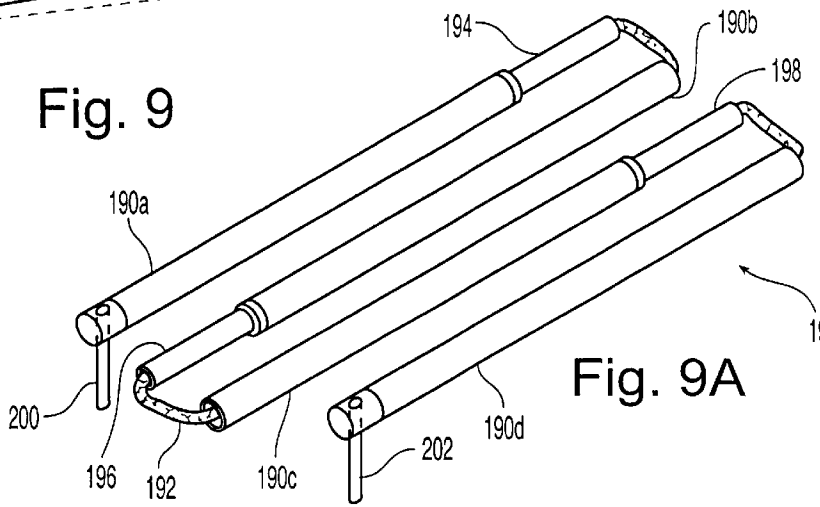
FIG. 9A is perspective view of an unassembled rod useful for allowing movement of the monitor constructed in accordance with the invention.
Figure 9B:
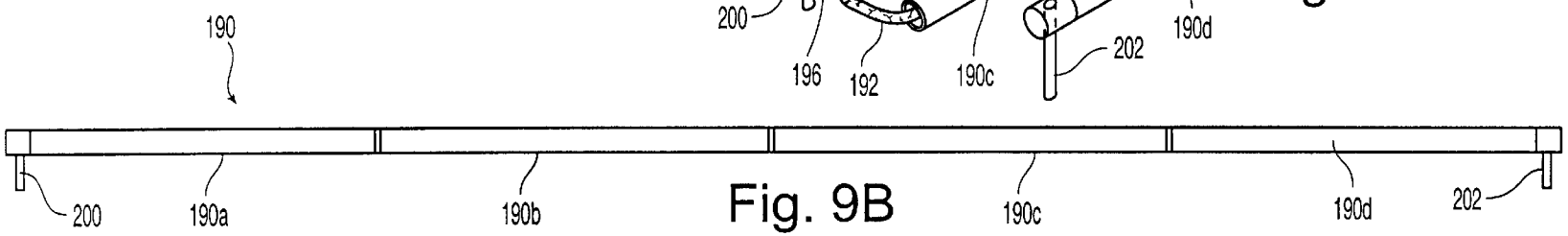
FIG. 9B is an elevational view of the rod of FIG. 9A shown in an assembled condition.

As a further means for providing portability to the launch monitoring systems of the present invention, and as shown in FIGS. 9A and 9B, rod 190 (which may also be the same as rod 22 for system 10) may be easily disassembled for transport and reassembled on site before operation of any of the disclosed launch monitoring systems. Specifically, rod 190 may comprise a plurality of sections 190*a–d*. Preferably, each of these sections comprises a hollow tube containing a single elastic cord 192 affixed at opposite ends of rod 190. Cord 192 has a relaxed length less than the total length of rod 190 in order to hold sections 190*a–d* together. Sections 190*a*, 190*b*, 190*c* have respective reduced diameter portions 194, 196, 198 that fit within respective ends of sections 190*b*, 190*c*, 190*d*. Pins 200, 202 are provided at opposite ends of rod 190 to allow the rod 190 to be secured into the turf.

Figure 18:
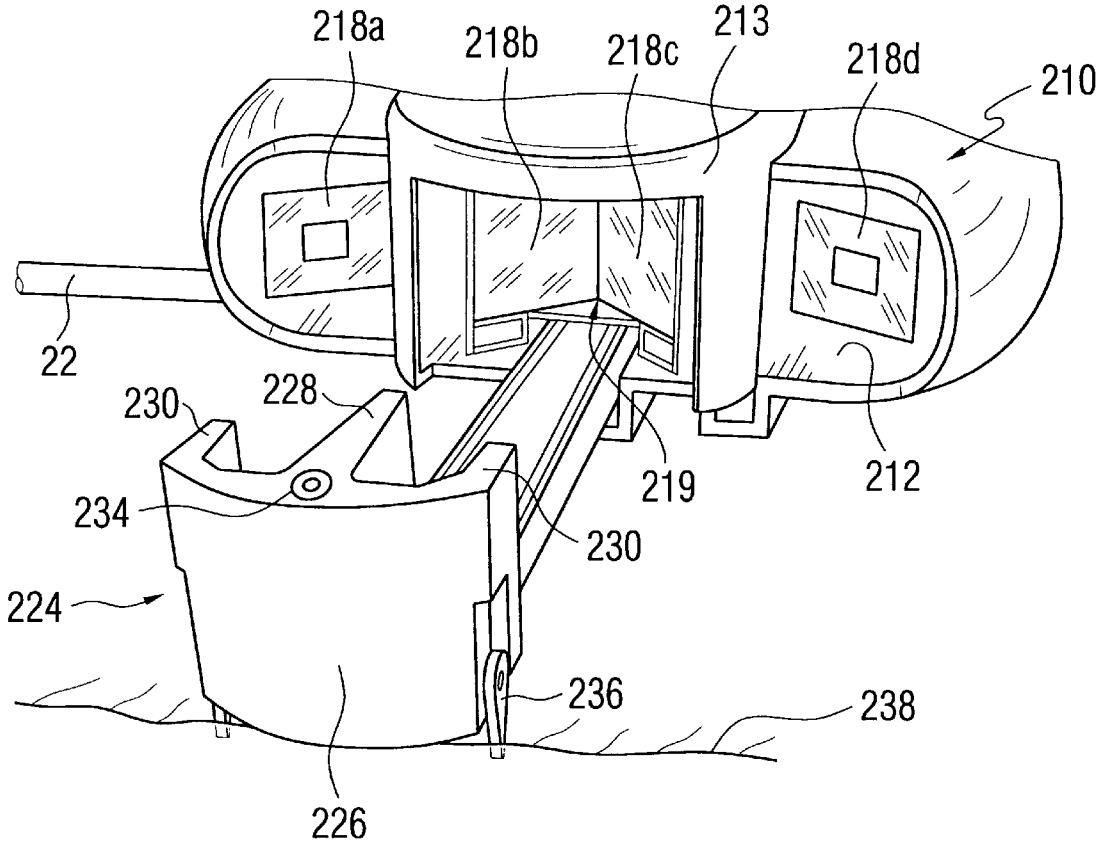
FIG. 18 is an enlarged, front, perspective view of the launch monitor of FIG. 16, wherein the calibration assembly is in the extended position.

The use of both systems 10 and 100 is generally in FIG. 18. At step S101, the system starts and determines if this is the first time the system has been used. By default, the system will use the last calibration when it is first activated. Therefore, the system must be calibrated each time the system is moved and/or turned on.

At step S102, the system is calibrated to define the coordinate system to be used by the system.

After the system is calibrated, the system is set at step S103 for either the left- or right-handed orientation, depending on the golfer to be tested. The selection of the left-handed orientation requires one set of coordinates are used for the left-handed golfer and right-handed system requires another set of coordinates for a right-handed golfer. At this time, the system is also set up as either a test or a demonstration. If the test mode is selected, the system will save the test data, while in the demonstration mode it will not save the data.

At step S103, additional data specific to the location of the test and the golfer is entered as well. Specifically, the operator enters data for ambient conditions such as temperature, humidity, wind speed and direction, elevation, and type of turf to be used in making the calculations for the golf ball flight, roll, and total distance. The operator also inputs the personal data of the golfer. This personal data includes name, age, handicap, gender, golf ball type (for use in trajectory calculations discussed below), and golf club used (type, club head, shaft).

After this data is entered, the system is ready for use and moves to step S104. At step S104, the system waits for a sound trigger from the microphone. When there is a sound of a sufficient level or type, the system takes two images (as shown in FIG. 4) of the golf ball in the predetermined field-of-view separated by a short time interval, preferably 800 microseconds, with each of the two cameras 136, 138 (as shown in FIG. 6). The images recorded by the silicon panel 39 are used by the system to determine the flight characteristics of the golf ball.

At steps S105–S107, the system uses several algorithms stored in the computer to determine the location of the golf ball relative to the monitor. After the computer has determined the location of the golf ball from the images, the system (and computer algorithms) determine the launch conditions. These determinations, which correspond to steps S105, S106, and S107, include locating the bright areas in the images, determining which of those bright areas correspond to the dots on the golf ball, and, then using this information to determine the location of the golf ball from the images, and calculate the launch conditions, respectively. Specifically, the system, at step S105, analyzes the images recorded by the cameras by locating the bright areas in the images. A bright area in the image corresponds to light from the flash bulb assembly 144 reflecting off of the retro-reflective dots or markers on the golf ball. Since the golf ball preferably has 6 dots on it, the system should find twelve bright areas that represent the dots in the images from each of the cameras (2 images of the golf ball with 6 dots). The system then determines which of those bright areas correspond to the golf ball's reflective dots at step S106. As discussed in detail below with reference to FIG. 14, this can be done in several ways. If only twelve dots are found in the image, the system moves on to step S107 to determine, from the dots in the images, the position and orientation of the golf ball during the first and second images. However, if there are more or less than twelve dots or bright areas found in the images, then at step S108 the system allows the operator to manually change the images. If too few bright areas are located, the operator adjusts the image brightness, and if too many are present, the operator may delete any additional bright areas. In some instances, the bright areas in the images may be reflections off of other parts of the golf ball or off the golf club head. If it is not possible to adequately adjust the brightness or eliminate those extraneous bright areas, then the system returns the operator to step S104 to have the golfer hit another golf ball. If the manual editing of the areas is successful, however, then the system goes to step S107.

At step S107, the system uses the identification of the dots in step S106 to determine the location of the centers of each of the twelve dots in each of the two images. Knowing the location of the center of each of the dots, the system can calculate the golf ball's spin rate, velocity, and direction.

At step S109, the system uses this information, as well as the ambient conditions and the golf ball information entered at step S103 to calculate the trajectory of the golf ball during the shot. The system will also estimate where the golf ball will land (carry), and even how far it will roll, giving a total distance for the shot. Because the system is calibrated in three dimensions, the system will also be able to calculate if the golf ball has been sliced or hooked, and how far off line the ball will be.

This information (i.e., the golfer's launch conditions) is then presented to the golfer at step S110, in numerical and/or graphical formats. At step S111, the system can also calculate the same information if a different golf ball had been used (e.g., a two-piece rather than a three-piece golf ball). It is also possible to determine what effect a variation in any of the launch conditions (golf ball speed, spin rate, and launch angle) would have on the results.

The golfer also has the option after step S112 to take more shots by returning the system to step S104. If the player had chosen the test mode at step S103 and several different shots were taken, at step S113 the system calculates and presents the average of all data accumulated during the test. At step S114, the system presents the golfer with the ideal launch conditions for the player's specific capabilities, thereby allowing the player to make changes and maximize distance. The system allows the golfer to start a new test with a new golf club, for example, at step S115, or to end the session at S116.

Figure 13:
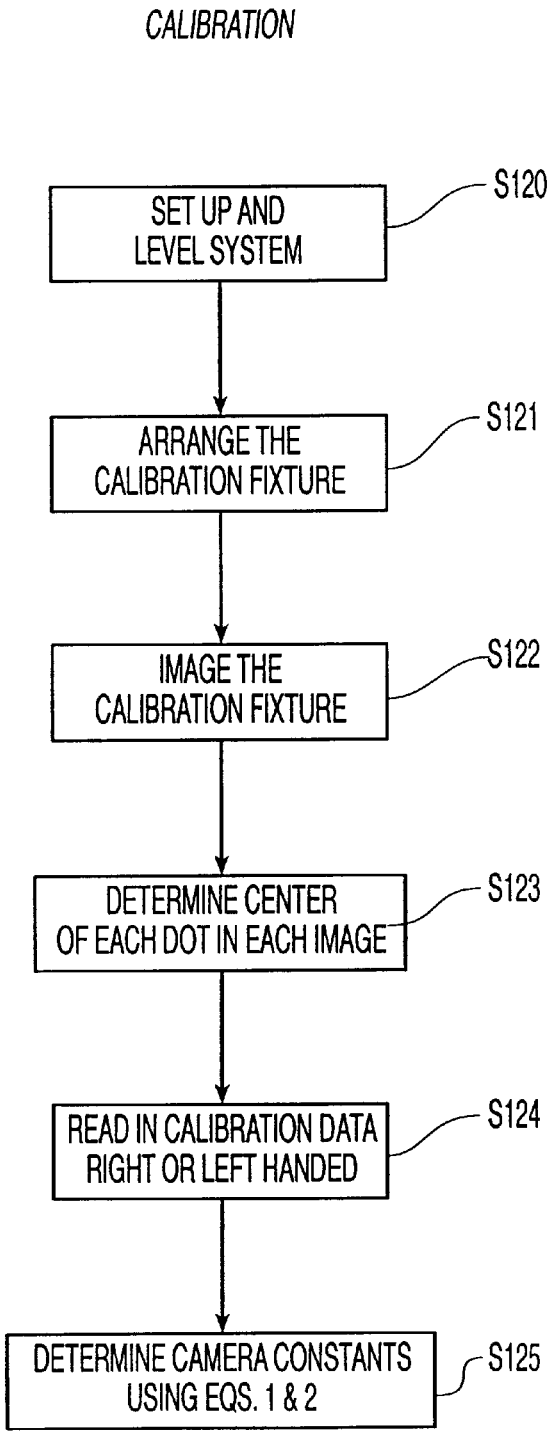
FIG. 13 is a flow chart describing the calibration of the launch monitor of FIGS. 1 and 6.

Now turning to the first of these steps in detail (FIG. 13), the calibration of the system begins with setting up and leveling the system in step S120. The system is preferably set up on level ground, such as a practice tee or on a level, large field. Obviously, it is also possible to perform the tests indoors, hitting into a net. Referring to FIGS. 6–8, to level the system, the operator uses the threaded rods 128, 130 and nuts 132, 134. Referring to FIGS. 7 and 8, the system is positioned to set the best view of the event and the predetermined field-of-view. Then at step S121, the calibration fixture 170 is placed in the appropriate location, which is at the end of the distance calibrators 158, 160. The calibration fixture 170 must be level and parallel to the system to ensure the best reflection of the light from the flash bulb assembly 144. Placing the calibration fixture at the end of the distance calibrators 158, 160 ensures that during the test, the calibration fixture 170 and the golf ball are in full view of each of the cameras. Both cameras take a picture of the calibration fixture and send the image to a buffer in step S122.

In step S123, the system, including a calibration algorithm, must then determine the location of the centers of the spots in each image corresponding to the calibration fixture's retro-reflective dots. In one embodiment, the system locates the centers of these spots by identifying the positions of the pixels in the buffer that have a light intensity greater than a predetermined threshold value. Since the images are two-dimensional, the positions of the pixels have two components (x,y). The system searches the images for bright areas and finds the edges of each of the bright areas. The system then provides a rough estimate of the centers of each of the bright areas. Then all of the bright pixels in each of the bright areas are averaged and an accurate dot position and size are calculated for all 15 areas. Those with areas smaller than a minimum area are ignored.

Once the location of each of the dots on the calibration fixture with respect to camera are determined, the system must know the true spacing of the dots on the calibration fixture. As shown in FIG. 11, the calibration fixture has dots arranged in three rows and five columns. The dots are placed about one inch apart, and on three separate X planes that are 1.5 inches apart. The X, Y, and Z coordinates of the center of each dot 170*a–o,* which are arranged in a three-dimensional pattern, were pre-measured to accuracy of one of one-ten thousandth of an inch on a digitizing table and stored in the computer. The system recalls the previously stored data of the three-dimensional positions of the dots on the calibration fixture relative to one another. The recalled data depends on the whether a right-handed (X-axis points toward the golfer) or a left-handed (X-axis points away from the golfer) system is used. Both sets of data are stored and can be selected by the operator at step S124. An exemplary set of these three dimensional positions for right hand calibration for the calibration fixture with 15 dots appear below:

| | | |
|---|---|---|
| (1) −1.5 3.0 0.0 | (2) 1.5 3.0 1.0 | (3) 0.0 3.0 2.0 |
| (4) 1.5 3.0 3.0 | (5) −1.5 3.0 4.0 | (6) −1.5 2.0 0.0 |
| (7) 1.5 2.0 1.0 | (8) 0.0 2.0 2.0 | (9) 1.5 2.0 3.0 |
| (10) −1.5 2.0 4.0 | (11) −1.5 1.0 0.0 | (12) 1.5 1.0 1.0 |
| (13) 0.0 1.0 2.0 | (14) 1.5 1.0 3.0 | (15) −1.5 1.0 4.0 |

An exemplary set of these three dimensional positions for left hand calibration for the calibration fixture with 15 dots appear below:

| | | |
|---|---|---|
| (1) 1.5 3.0 4.0 | (2) −1.5 3.0 3.0 | (3) 0.0 3.0 2.0 |
| (4) −1.5 3.0 1.0 | (5) 1.5 3.0 0.0 | (6) 1.5 2.0 4.0 |
| (7) −1.5 2.0 3.0 | (8) 0.0 2.0 2.0 | (9) −1.5 2.0 1.0 |
| (10) 1.5 2.0 0.0 | (11) 1.5 1.0 4.0 | (12) −1.5 1.0 3.0 |
| (13) 0.0 1.0 2.0 | (14) −1.5 1.0 1.0 | (15) 1.5 1.0 0.0 |

At step S125, using the images of the calibration fixture, the system determines eleven (11) constants relating image space coordinates U and V to the known fifteen X, Y, and Z positions on the calibration fixture. The equations relating the calibrated X(I), Y(I), Z(I) spaced points with the $U_i^j$, $V_i^j$ image points are:

$$U_i^j = \frac{D_{1j}X(i) + D_{2j}Y(i) + D_{3j}Z(i) + D_{4j}}{D_{9j}X(i) + D_{10j}Y(i) + D_{11j}Z(i) + 1} \quad \text{(Eq.1)}$$

where $i = 1, 15$; $j = 1, 2$.

$$V_i^j = \frac{D_{5j}X(i) + D_{6j}Y(i) + D_{7j}Z(i) + D_{8j}}{D_{9j}X(i) + D_{10j}Y(i) + D_{11j}Z(i) + 1} \quad \text{(Eq.2)}$$

The eleven constants, $D_{i1}$(I=1,11), for camera 136 and the eleven constants, $D_{i2}$ (I=1,11), for camera 138 are solved from knowing X(I), Y(I), Z(I) at the 15 locations and the 15 $U_i^j$, $V_i^j$ coordinates measured in the calibration photo for the two cameras.

In another embodiment, during image analysis the system uses the standard Run Length Encoding (RLE) technique to locate the bright areas. The RLE technique is conventional and known by those of ordinary skill in the art. Image analysis can occur during calibration or during an actual shot. Once the bright areas are located using the RLE technique, the system then calculates an aspect ratio of all bright areas in the image to determine which of the areas are the retro-reflective markers. The technique for determining which bright areas are the dots is discussed in detail below with respect to FIG. 14.

As noted above, once the system is calibrated in step S102, the operator can enter the ambient conditions, including temperature, humidity, wind, elevation, and turf conditions. Next, the operator inputs data about the golfer. For example, the operator enters information about the golfer, including the golfer's name, the test location, gender, age and the golfer's handicap. The operator also identifies the golf ball type and club type, including shaft information, for each test.

A golf ball is then set on a tee where the calibration fixture was located and the golfer takes a swing. The system is triggered when a sound trigger from the club hitting the golf ball is sent via microphone to the system. The strobe light unit is activated causing a first image to be recorded by both cameras. There is an intervening, predetermined time delay, preferably 800 microseconds, before the strobe light flashes again. The time delay is limited on one side by the ability to flash the strobe light and on the other side by the field-of-view. If the time delay is too long, the field-of-view may not be large enough to capture the golf ball in the cameras' views for both images. The cameras used in the systems 10 and 100 allow for both images (which occur during the first and the second strobe flashes) to be recorded in one image frame. Because the images are recorded when the strobe light flashes (due to reflections from the retro-reflective material on the golf ball), the flashes can be as close together as needed without concerns for the constraints of a mechanically shuttered camera.

This sequence produces an image of the reflections of light off of the retro-reflective dots on each light sensitive panel of the cameras. The location of the dots in each of the images are preferably determined with the RLE technique which was discussed for the calibration fixture.

$$S_x=\Sigma X_i \quad \text{(Eq. 3)}$$

$$S_y=\Sigma Y_i \quad \text{(Eq. 4)}$$

$$S_{xx}=\Sigma X_i^2 \quad \text{(Eq. 5)}$$

$$S_{yy}=\Sigma Y_i^2 \quad \text{(Eq. 6)}$$

Figure 14:
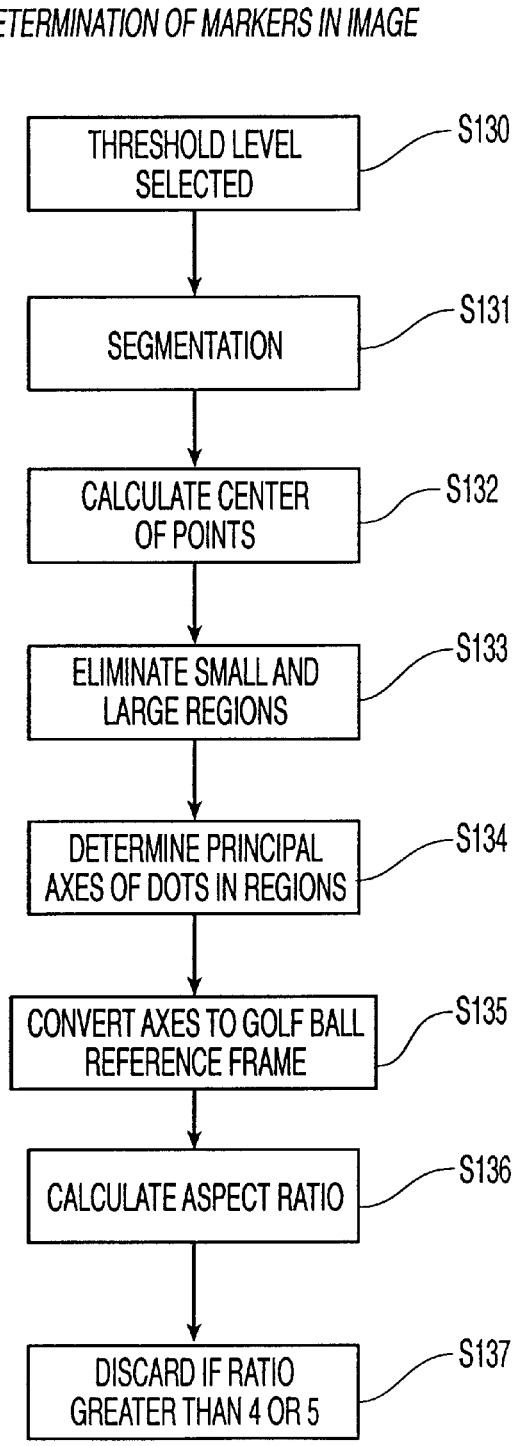
FIG. 14 is a flow chart describing the determination of dots in the image.

The technique used for determining the aspect ratio to determine which bright areas are dots will now be described in conjunction with FIG. 14. As shown in step S130, the image must have an appropriate brightness threshold level chosen. By setting the correct threshold level for the image to a predetermined level, all pixels in the image are shown either as black or white. Second, at step S131, the images are segmented into distinct segments, corresponding to the bright areas in each of the images. The system, at step S132, determines the center of each area by first calculating the following summations at each of the segments using the following equations:

$$S_{xy}=\Sigma X_i Y_i \quad \text{(Eq. 7)}$$

Once these sums, which are the sums of the bright areas, have been accumulated for each of the segments in the image, the net moments about the x and y axes are calculated using the following equations:

$$I_x = S_{xx} - \frac{S_x^2}{AREA} \quad \text{(Eq. 8)}$$

$$I_y = S_{yy} - \frac{S_y^2}{AREA} \quad \text{(Eq. 9)}$$

$$I_{xy} = S_{xy} - \frac{S_x S_y}{AREA} \quad \text{(Eq. 10)}$$

where AREA is the number of pixels in each bright area.

At step S133, the system eliminates those areas of brightness in the image that have an area outside a predetermined range. Thus, areas that are too large and too small are eliminated. In the preferred embodiment, the dots on the golf ball are ¼"–⅛" and the camera has 753×244 pixels, so that the dots should have an area of about 105 pixels in the images. However, glare by specular reflection, including that from the club head and other objects, may cause additional bright areas to appear in each of the images. Thus, if the areas are much less or much more than 105 pixels, then the system can ignore the areas since they cannot be a marker on the golf ball.

For those areas that remain (i.e., that are approximately 105 pixels) the system determines which are the correct twelve in the following manner. The system assumes that the dots will leave an elliptical shape in the image due to the fact that the dots are round and the golf ball's movement during the time that the strobe light is on. Therefore, at step S134 the system then calculates the principal moments of inertia of each area using the following equations:

$$I_{x'} = \frac{I_x + I_y}{2} + \sqrt{\left(\frac{I_x - I_y}{2}\right)^2 + I_{xy}^2} \quad \text{(Eq. 11)}$$

$$I_{y'} = \frac{I_x + I_y}{2} - \sqrt{\left(\frac{I_x - I_y}{2}\right)^2 + I_{xy}^2} \quad \text{(Eq. 12)}$$

Finally, at step S136 the aspect ratio is calculated using the following equation:

$$R = \frac{I_{x'}}{I_{y'}} \quad \text{(Eq. 13)}$$

and the dot is rejected at step S137 if the aspect ratio is greater than four or five.

Returning to FIG. 12, once the locations of the dots are determined, the system computes the translational velocity of the center of the golf ball and angular velocity (spin rate) of the golf ball at step S107 in the following manner. First, the system uses the triangulation from the data of cameras to locate the position of the six dots on the surface of the golf ball. Specifically, the system solves the set of four linear equations shown below to determine the position (x,y,z) in the golf ball's coordinate system of each dot on the surface of the golf ball.

$$(D_{9,1}U^1-D_{1,1})x+(D_{10,1}U^1-D_{2,1})y+(D_{11,1}U^1-D_{3,1})z+(U^1-D_{4,1})=0 \quad \text{(Eq. 14)}$$

$$(D_{9,1}V^1-D_{5,1})x+(D_{10,1}V^1-D_{6,1})y+(D_{11,1}V^1-D_{7,1})z+(V^1-D_{8,1})=0 \quad \text{(Eq. 15)}$$

$$(D_{9,2}U^2-D_{1,2})x+(D_{10,2}U^2-D_{2,2})y+(D_{11,2}U^2-D_{3,2})z+(U^2-D_{4,2})=0 \quad \text{(Eq. 16)}$$

$$(D_{9,2}V^2-D_{5,2})x+(D_{10,2}V^2-D_{6,2})y+(D_{11,2}V^2-D_{7,2})z+(V^2-D_{8,2})=0 \quad \text{(Eq. 17)}$$

where $D_{i,j}$ are the eleven constants determined by the calibration method at steps S102 (FIG. 12) and S125 (FIG. 13), where i identifies the constant and j identifies the image.

Next, the system converts the dot locations (determined at step S135, FIG. 14) in the golf ball coordinate system to the reference global system of the calibrated cameras 136, 138 using the following matrix equation:

$$\begin{bmatrix} x_g \\ y_g \\ z_g \end{bmatrix} = \begin{bmatrix} T_x \\ T_y \\ T_z \end{bmatrix} + \begin{bmatrix} M_{11} & M_{12} & M_{13} \\ M_{21} & M_{22} & M_{23} \\ M_{31} & M_{32} & M_{33} \end{bmatrix} \begin{bmatrix} x_b \\ y_b \\ z_b \end{bmatrix} \quad \text{(Eq. 18)}$$

where Xg, Yg, Zg are the global coordinates of the center of the golf ball. The column vector, $T_x,T_y,T_z$, is the location of the center of the golf ball in the global coordinate system. The matrix elements $M_{ij}$(i=1,3; j=1,3) are the direction cosines defining the orientation of the golf ball coordinate system relative to the global system. The three angles $a_1,a_2,a_3$ describe the elements of matrix $M_{ij}$ in terms of periodic functions. Substituting matrix equation for the global position of each reflector into the set of four linear equations shown above, a set of 28 equations result for the six unknown variables ($T_x,T_y,T_z,a_1,a_2,a_3$). A similar set of 28 equations must be solved for the second image of the golf ball. Typically, the solution of the three variables $T_x,T_y,T_z$ and the three angles at $a_1,a_2,a_3$ that prescribed the rotation matrix M is solvable in four iterations for the 28 equations that must be simultaneously satisfied.

The kinematic variables, three components of translational velocity and three components of angular velocity in the global coordinate system, are calculated from the relative translation of the center of mass and relative rotation angles that the golf ball makes between its two image positions.

The velocity components of the center of mass $V_x,V_y,V_z$ along the three axes of the global coordinate system are given by the following equations:

$$V_x = \frac{T_x(t+\Delta T) - T_x(t)}{\Delta T};\ V_y = \frac{T_y(t+\Delta T) - T_y(t)}{\Delta T};$$

$$V_z = \frac{T_z(t+\Delta T) - T_z(t)}{\Delta T}$$

(Eqs. 19, 20, and 21, respectively) in which t is the time of the first strobe measurement of $T_x,T_y,T_z$ and ΔT is the time between images.

The spin rate components in the global axis system result from obtaining the product of the inverse orientation matrix, $M^T(t)$ and M(t+ΔT). The resulting relative orientation matrix, A, $A(t,t+\Delta t)=M(t+\Delta t)M^T(t)$, measures the angular difference of the two strobe golf ball images.

The magnitude Θ of the angle of rotation about the spin axis during the time increment ΔT is given by:

$$\theta = \sin^{-1}\left(\frac{R}{2}\right) \quad \text{(Eq. 22)}$$

where $R=\sqrt{l^2+m^2+n^2}$;

$l=A_{32}-A_{23}$; $m=A_{13}-A_{31}$; and $n=A_{21}-A_{12}$.

The three orthogonal components of spin rate, $W_x,W_y,W_z$, are given by the following equations:

$$W_x = \frac{\Theta L}{R\Delta t} \quad \text{(Eq. 23)}$$

-continued $$W_y = \frac{\Theta M}{R\Delta t} \quad \text{(Eq. 24)}$$

$$W_z = \frac{\Theta N}{R\Delta t} \quad \text{(Eq. 25)}$$

Figure 12:
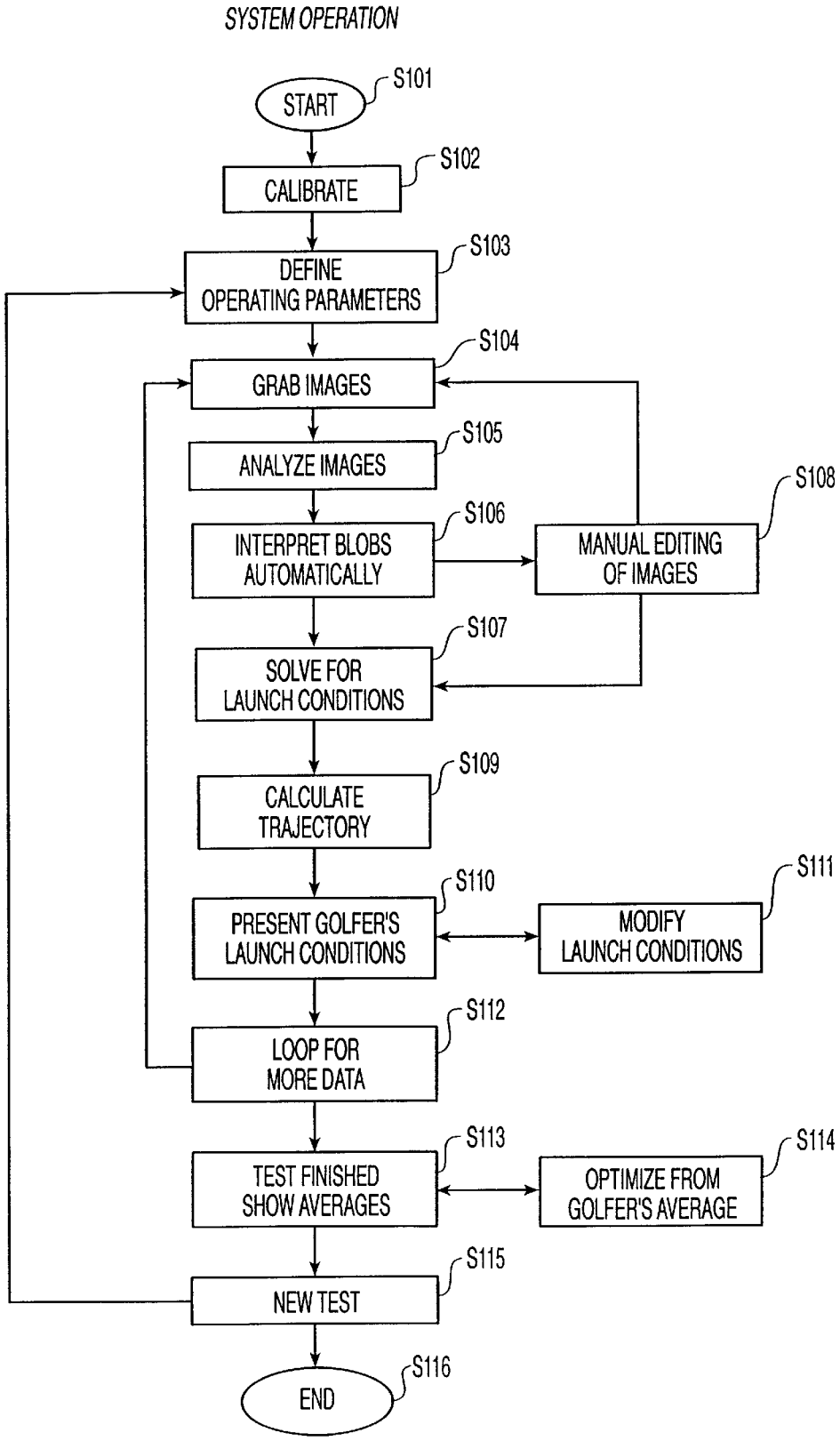
FIG. 12 is a flow chart describing the operation of the system.

At step S109 of FIG. 12, the system, including a computer algorithm, then computes the trajectories for the tests using the initial velocity and initial spin rate which were computed in step S107. For each time increment, the system interpolates the forces on the golf ball at time T and calculates the velocity at time T+1 from the velocity of the golf ball and the forces on the golf ball at time T. Next, the system computes the mean velocity and the Reynold's number, which is the ratio of the flow's inertial forces to the flow's viscous forces during the time interval from time T to time T+1. The system then interpolates the mean forces, from which the system calculates the velocity at time T+1. The forces include the drag force, the lift due to the spin of the golf ball, and gravitational forces. Using the velocity at time T+1, the system can compute the position at time T+1. Finally, the system computes the spin rate at time T+1. In the preferred embodiment, the length of the time interval is 0.1 seconds. This calculation is performed until the golf ball reaches the ground.

The system uses the following equations to perform these calculations. For the drag force on the golf ball, the force is calculated by:

$$F_d = c_d * 1/2 * \rho * |V^{Bf}|^{2*} A; \quad \text{(Eq. 26)}$$

where $c_d$=drag coefficient previously determined and stored in a data file that is called when the golf ball type is selected;

ρ=density of air—entered at step S103, the beginning of the test;

$|V^{Bf}|$=magnitude of the velocity of the golf ball; and

A=the cross-sectional area of the golf ball—also known from the golf ball selected.

The lift, caused by the spin of the golf ball, is perpendicular to the velocity direction and spin direction and is given by:

$$\underline{n}_L = \underline{N}_\omega \times \underline{n}_{VB}, \quad \text{(Eq. 27)}$$

where $\underline{n}_L$, $\underline{N}_\omega$, and $\underline{n}_{VB}$ are the direction cosines of the lift force, the angular rotation of the golf ball, and the velocity of the golf ball, respectively.

The magnitude of the lift is given by:

$$F_L = c_L * 1/2 * \rho * |V^{Bf}|^{2*} A \quad \text{(Eq. 28)}$$

where, $c_L$ is the lift coefficient and the other terms being defined above.

Therefore, the applied aerodynamic force on the golf ball becomes $$\underline{R}^B = \underline{n}_L F_L - \underline{n}_{VB} F_d \quad \text{(Eq. 29)}$$

The velocity and spin of the golf ball are then transformed into the X, Y, and Z directions so that generalized velocities and rotational velocities are given by $$\underline{V}^{Bf} = u_9 \underline{X} + u_{10} \underline{Y} + u_{11} \underline{Z} \quad \text{(Eq. 30)}$$

$$\underline{\omega}^{Bf} = u_{12} \underline{X} + u_{13} \underline{Y} + u_{14} \underline{Z} \quad \text{(Eq. 31)}$$

where $u_9$, $u_{10}$, and $u_{11}$ are the velocities in the X, Y, and Z directions; and $u_{12}$, $u_{13}$, and $u_{14}$ are the spin velocities in the X, Y, and Z directions.

Using these equations, the system obtains the following second order differential equations:

$$n_{lx}*F_1-n_{Vbx}*F_d-m_B*u_9=0 \quad \text{(Eq. 32)}$$

$$n_{ly}*F_1-n_{Vby}*F_d-m_B*u_{10}=0 \quad \text{(Eq. 33)}$$

$$n_{lz}*F_1-n_{Vbz}*F_d-m_B*u_{11}m_B*g=0 \quad \text{(Eq. 34)}$$

where $n_{lx}$, $n_{ly}$, $n_{lz}$ are the direction cosines of the force in the X, Y, and Z directions, respectively;

$n_{Vbx}$, $n_{Vby}$, and $n_{Vbz}$ are the directions of the velocity vectors in the X, Y, and Z directions, respectively;

$m_B$ is the mass of the ball; and $m_B*g$ relates to the gravitational force exerted on the golf ball in the Z direction.

These second order differential equations are then solved for each time step, preferably every 0.1 second using the drag and lift coefficients ($C_d$ and $C_L$) from data files, or from another source, based upon the velocity ($\underline{V}^{Bf}$) and angular velocity ($\omega^{Bf}$) at each of those time steps.

Figure 15:
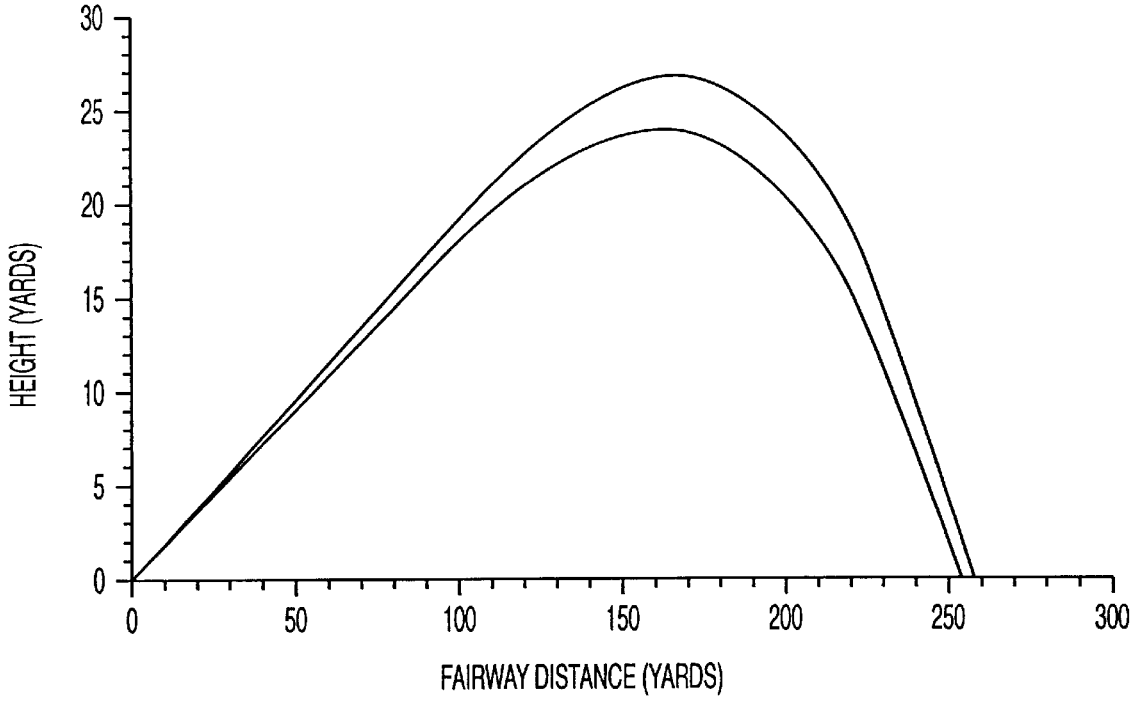
FIG. 15 is a graph showing the trajectory of the golf ball as calculated by the system.

The trajectory method repeats this procedure for successive time intervals until the computed elevation component of the golf ball's position is less than a predetermined elevation, usually zero or ground level. See FIG. 15. When the golf ball reaches ground level, the method interpolates to compute the ground impact conditions including final velocity, trajectory time, impact angle, and spin rate. Using a roll model based on empirical data and golf ball data input by the operator, the system computes the final resting position of the golf ball using the just-computed ground impact conditions. Accordingly, the system computes the total distance from the tee to the final resting position of the golf ball. A data file stores the results computed by the trajectory method.

Referring again to FIG. 12, the system then determines whether an additional test will be performed. If additional tests are to be performed, the process described above repeats, beginning at step S104 with the sound trigger through step S110 where the trajectory method computes and presents the trajectory for the golf ball.

When all tests have been performed, the analysis method computes statistics for each golf ball type used in the tests and presents the results to the operator. For the group of tests performed for each golf ball type, the system computes the average value and standard deviation from the mean for several launch characteristics including the velocity, the launch angle, the side angles, the backspin, the side spin, and the carry and roll.

Different factors contribute to the standard deviation of the measurements including the variation in the compression and resilience of the golf balls, the variation in the positioning of the dots on the golf balls, the pixel resolution of the light sensitive panels and the accuracy of the pre-measured dots on the calibration fixture. Obviously, the primary source of scatter lies in the swing variations of the typical golfer.

Upon request from the operator, the system will display the test results in various forms. For example, the system will display individual results for the golf ball type selected by the operator.

Similarly, the system in step S113 can also display tabular representations of the trajectories for the golf ball types selected by the operator. The tabular representation presents trajectory information including distance, height, velocity, spin, lift, drag, and the Reynold's number. Similarly, the analysis method displays graphical representation of the trajectories for the golf ball types selected by the operator. The system computes the graphical trajectories from the average launch conditions computed for each golf ball type.

At step S113, the system displays the average of each of the shots taken by the golfer. The results are displayed in a tabular and/or graphical format. The displayed results include the total distance, the spin rate, the launch angle, distance in the air, and golf ball speed. From this information, the system at step S114 shows the golfer the results if the launch angle and spin rate of the golf ball were slightly changed, allowing the golfer to optimize the equipment and/or swing.

At step S114, the system calculates the distances of a golf ball struck at a variety of launch angles and spin rates that are close to those for the golfer. The operator is able to choose which launch angles and spin rates are used to calculate the distances. In order to display this particular data, the system performs the trajectory calculations described above between about 50–100 times (several predetermined values of launch angles and several predetermined values of initial spin rates). The operator can dictate the range of launch angles and spin rates the system should use, as well as how many values of each the system uses in the calculations. From the graphical data (*), the golfer can determine which of these two variables could be changed to improve the distance.

Since the golfer's data is saved, when the system is in the test mode, it is also possible to compare the golfer's data with that of other golfers, whose data were also saved. In this way, it is possible for golfers to have their data (launch angle, initial golf ball speed, spin rate, etc.) compared to others. This comparison may be done in a tabular or graphical format. Similarly, the system may compare the data from successive clubs (e.g., a 5-iron to a 6-iron to a 7-iron) to determine if there are gaps in the clubs (inconsistent distances between each of the clubs). Alternatively, two different golfers could be compared using the same or different clubs, or the same or different balls.

EXAMPLE

After calibration, a golf machine struck six balata wound golf balls and six two-piece solid golf balls under the same conditions. The following data for golf ball movement was obtained:

| Units | Ball Speed mph | Launch Angle degrees | Side Angle degrees | $W_x$ Rate rpm | $W_y$ Rate rpm | $W_z$ Rate rpm |
|---|---|---|---|---|---|---|
| Average (Wound) | 156.7 | 8.5 | −0.7 | −4403 | 3 | 193 |
| Standard Deviation | 0.8 | 0.4 | 0.2 | 184 | 78 | 115 |
| Average (Two-Piece) | 156.6 | 8.8 | −0.7 | −3202 | 3 | −23 |
| Standard Deviation | 1.0 | 0.3 | 0.2 | 126 | 197 | 137 |

These results illustrate the effect of two different golf ball constructions on launch conditions. The launch variable primarily affected is the resulting backspin of the golf ball ($W_x$ rate) on squarely hit golf shots. A secondary effect is the lower launch angle of wound construction versus two-piece solid golf balls with high modulus ionomer cover material.

Figure 16:
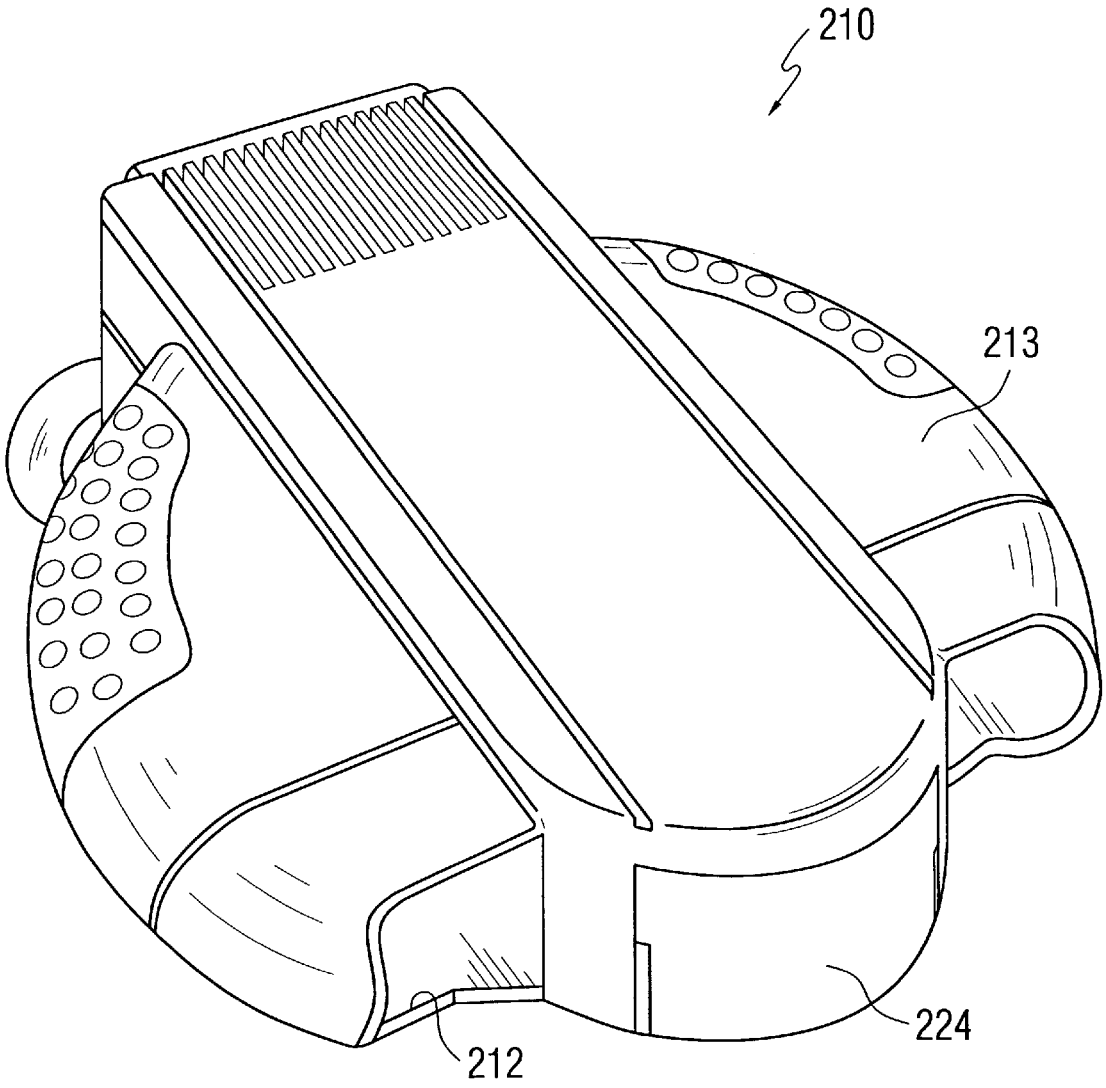
FIG. 16 is a front, perspective view of a third embodiment of a launch monitor of the present invention, wherein a calibration assembly is in a retracted position.
Figure 16A:
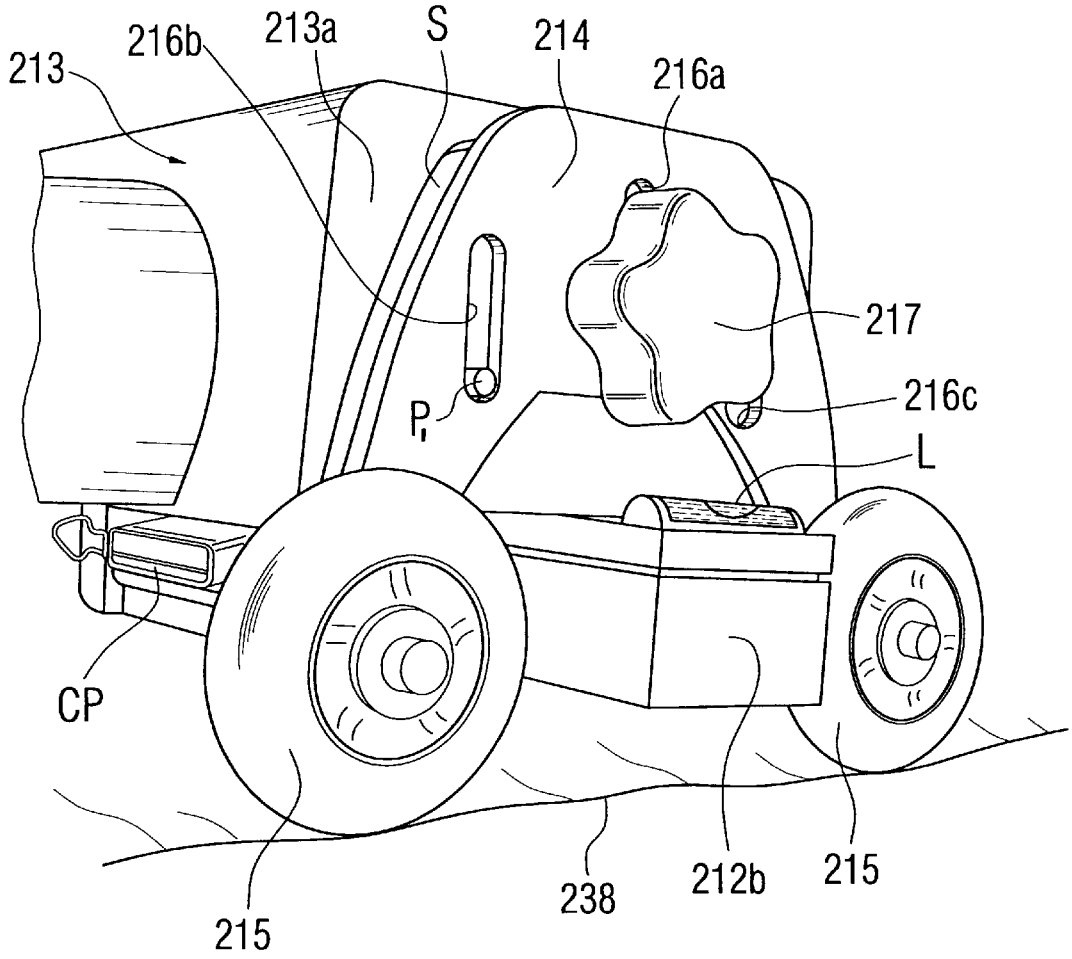
FIG. 16A is a rear, perspective view of the launch monitor shown in FIG. 16.
Figure 17:
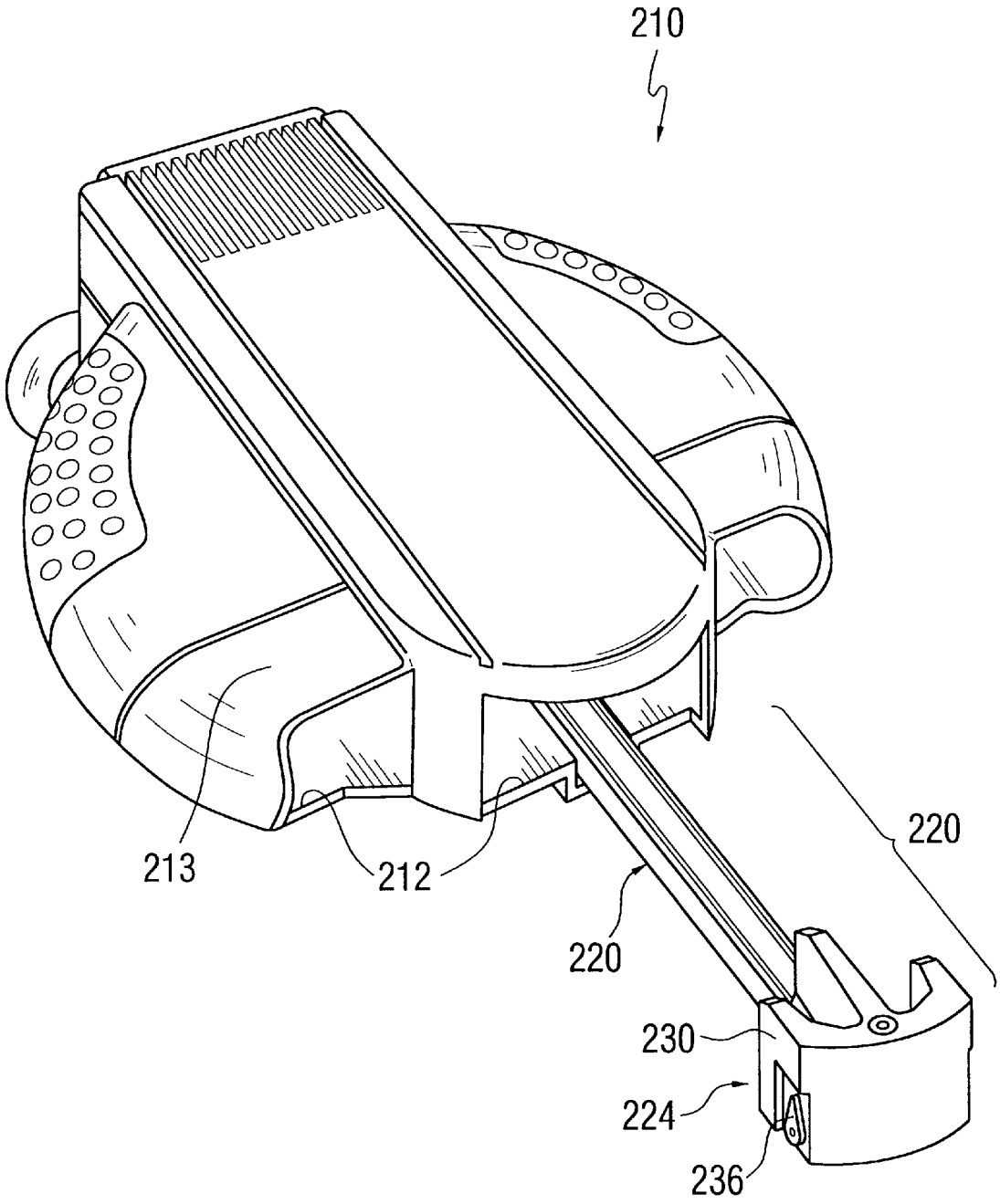
FIG. 17 is a front, top, perspective view of the launch monitor of FIG. 16, wherein the calibration assembly is in an extended position.

Referring to FIGS. 16–18, an alternative embodiment of a launch monitor 210 includes a base or support structure 212 and a cover or housing 213. A single, central slide member or pad (not shown) similar to pad 114 (shown in FIG. 6) is utilized at a lower front portion of support structure 112. The pad is operatively associated with rod 22. The monitor 210 also includes a U-shaped wall 214 to which wheels 215 are rotatably connected. The wall 214 defines at least one vertical slots 216*a–c*. The slot 216 receives a threaded shaft (not shown). A spacer S is disposed on the rear wall 213*a* of the housing 213. One end of the threaded shaft is connected to the spacer S, and the other end is connected to the knob 217. The spacer S includes pins $P_1$ that are slidably disposable with slots 216*b* and 216*c* for helping align the monitor.

The housing 213 support structure further includes a rectangular extension 212*b* for receiving a telescoping member as discussed below. The upper surface of the extension 212*b* has a monitor level L thereon.

In order to adjust the angle of the monitor, the knob 217 is loosened and the threaded shaft is moved vertically within the slot 216*a* to adjust the angle of the monitor as indicated by level L. When the monitor is at the appropriate angle, the knob 217 is tightened.

Although, not shown, the monitor 210 is for use with a computer and monitor 43 (as shown in FIG. 1). The computer is coupled to the electronics within the monitor 216 via computer port CP. The remainder of the monitor system is similar to system 100. For example, the monitor 210 includes, referring to FIG. 18, light reflective panels 218*a–d* within the housing 213. The panels 218*a* and *b* and the housing 218 define a space 219 in the front of the monitor.

Figure 19:
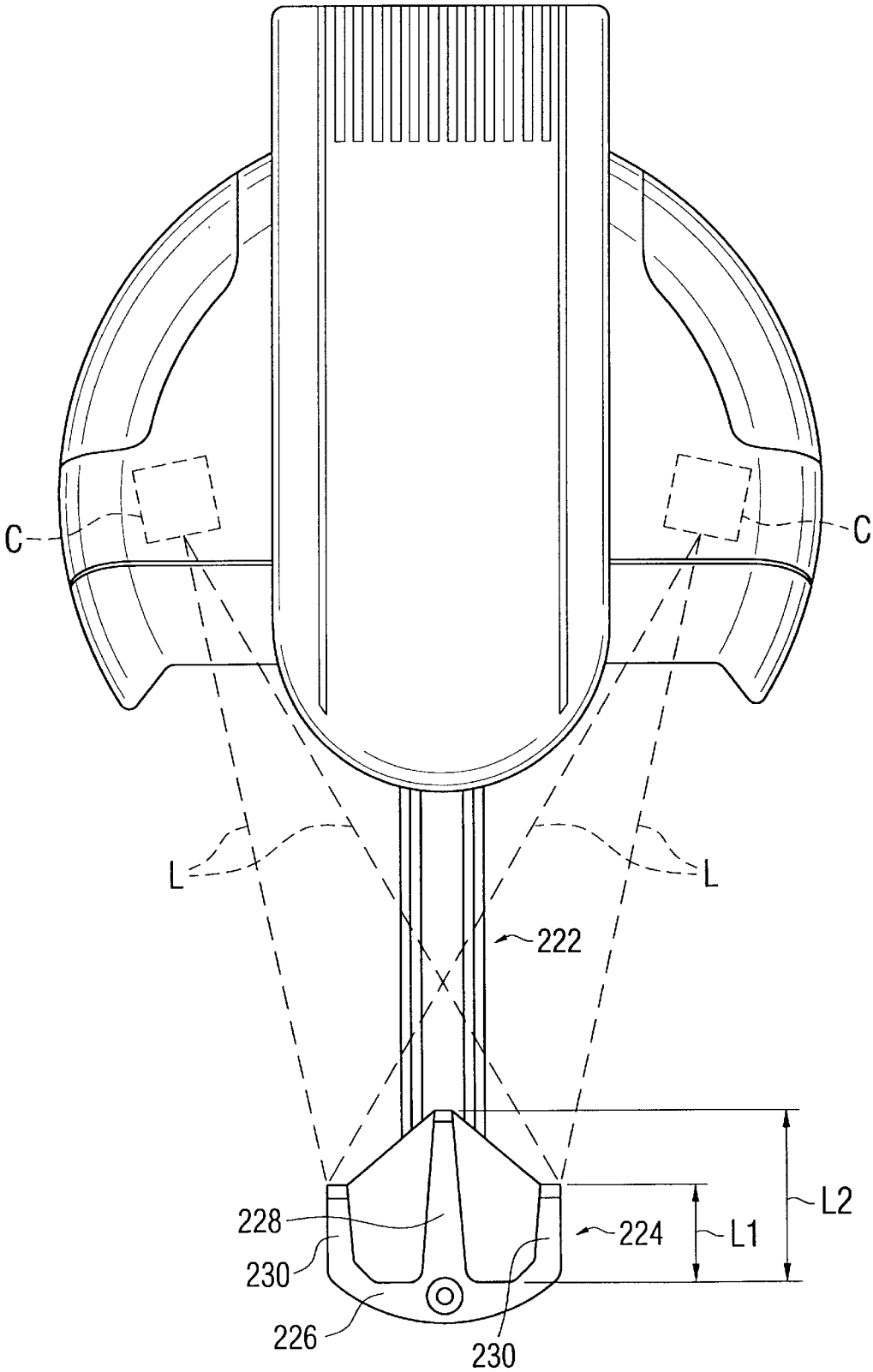
FIG. 19 is an enlarged, top, perspective view of the launch monitor of FIG. 16, wherein the calibration assembly is in the extended position.

Referring to FIG. 17, the calibration assembly 220 includes one telescoping member or distance calibrator 222 and a calibration fixture 224. One end of the telescoping member 222 is coupled to the support structure 212. The other end of the telescoping member is coupled to a calibration fixture 224. Preferably, the telescoping member 222 is a drawer slide with bearings (not shown). One recommended drawer slide is commercially available from Allied Hardware of Far Rockaway, N.Y., under part number 3832. Preferably the drawer slide has a retracted length so that the space 219 receives the fixture 224 when the telescoping member 222 is in a retracted position. Referring to FIG. 19, the telescoping member 222 has an extended length so that the fixture 224 is in the line of sight L of each camera C, when the telescoping member 222 is in an extended position.

Figure 20:
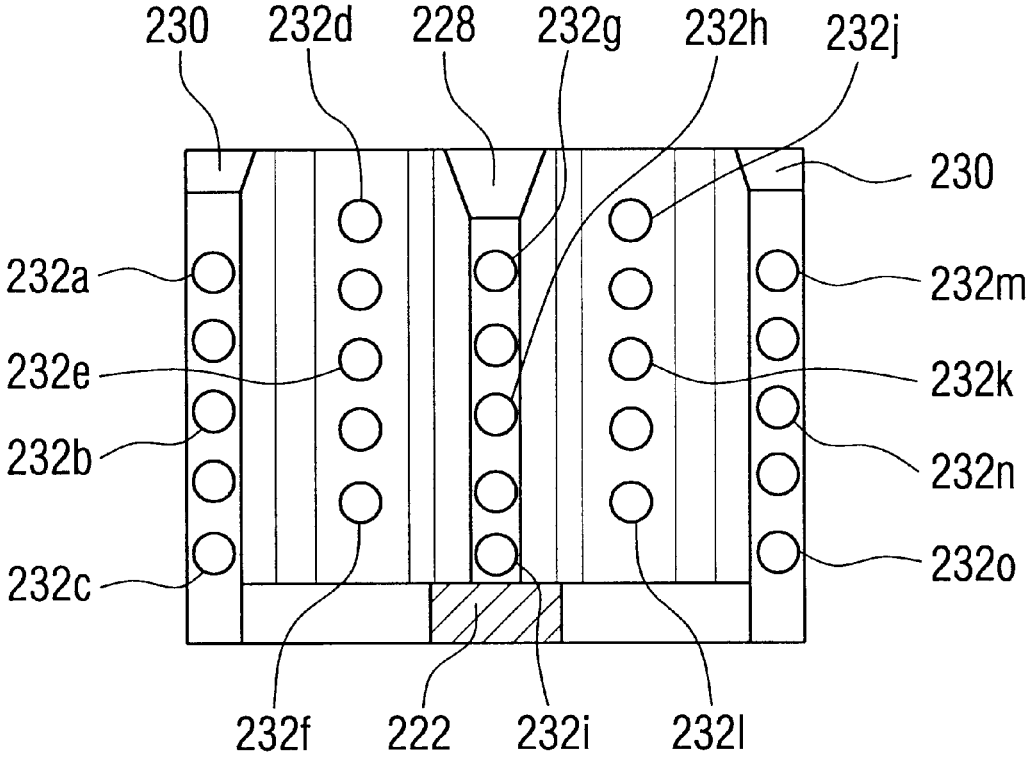
FIG. 20 is an enlarged, front, perspective view of the calibration fixture showing a plurality of contrasting areas.

Referring to FIGS. 18–20, the fixture 224 includes a back wall 226, a central leg 228 extending from the back wall 226, outer legs 230 extend from the back wall 226 spaced from the central leg 228. The length of the central leg 228 from the front surface of the back wall 226 is designated as L1. The length of the outer legs 230 from the front surface of the back wall 226 is designated as L2. In this embodiment, the length L2 of the outer legs 230 is less than the length of the central leg 228 so that the cameras C can view all of the free ends of the legs 228 and 230, and the back wall 226.

As best shown in FIG. 20, fixture 224 has a pattern of contrasting areas or retro-reflective dots 232*a–o*. The recommended number of dots is 15, however as few as six can be used, as discussed above. Since the areas 232*a–o* are disposed on the back wall 226, free end of the central leg 228, and the free ends of the outer legs 230, the dots are located in three dimensions or planes. However, the dots can also be located only within two dimensions or planes. The calibration fixture 224 is used as discussed above with respect to system 100 to determine the calibration data.

Referring to FIGS. 18, calibration fixture 224 further includes an optical level indicator 234 on a top surface of the back wall 226 for allowing the fixture 234 to be leveled before the calibration procedure. Preferably the level indicator 234 is a bubble level commercially available from McMaster Carr of Atlanta, Ga., under part number 2201A63. The level is glued to the fixture.

Referring to FIGS. 17 and 18, the calibration fixture 224 further includes leveling legs 236 pivotally mounted to the outer legs 230. The legs 236 pivot from a stowed position (as shown in FIG. 17) to an extended position (as shown in FIG. 18). In the extended position, the legs 236 extend below the lower surface of the fixture. The legs are inserted into the ground 238 to different or equal degrees so that the fixture 224 is level during the calibration procedure.

Figure 21:
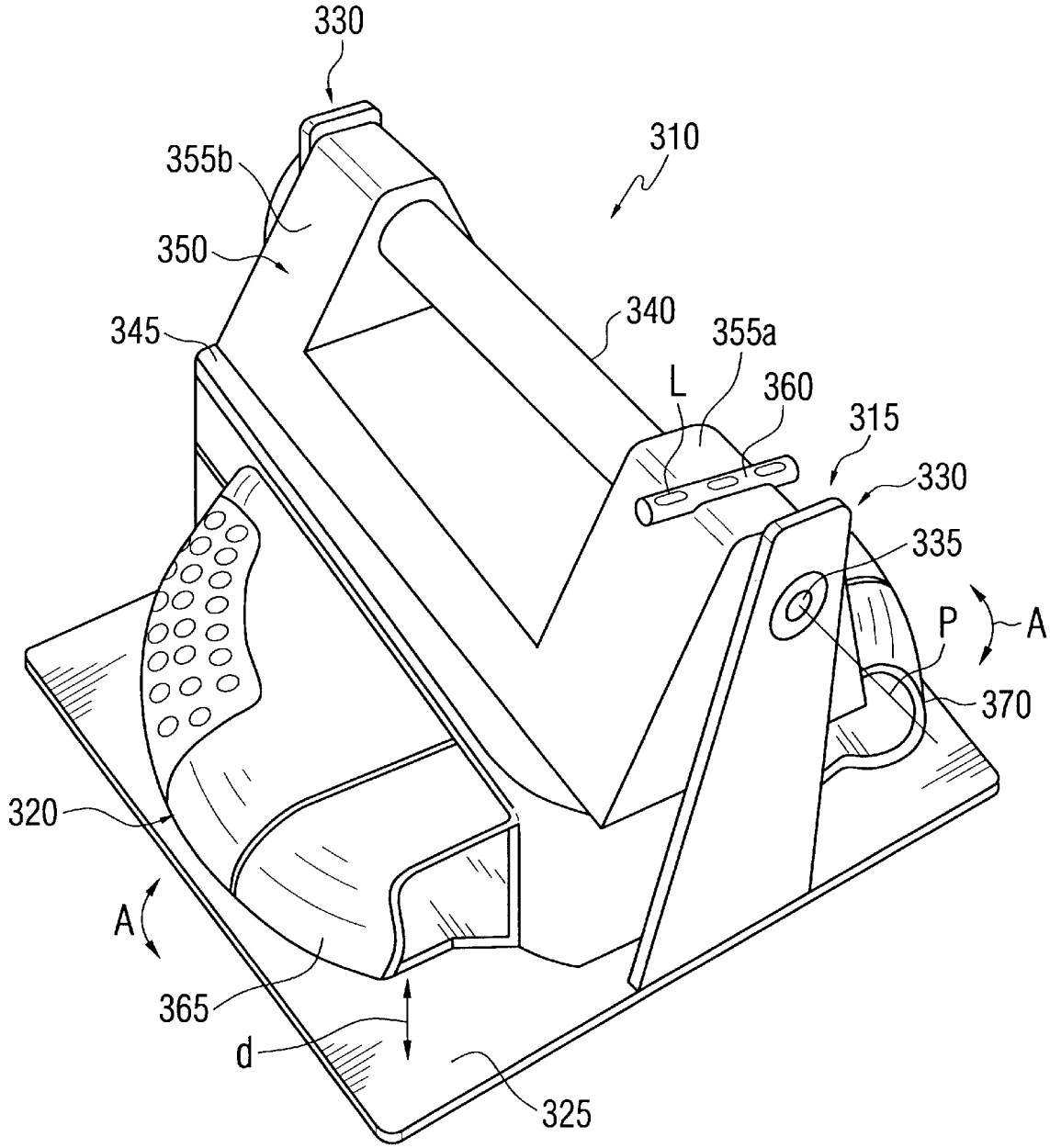
FIG. 21 is a perspective view of a self-leveling, fourth embodiment of the launch monitor of the present invention.

Referring to FIG. 21, an alternative embodiment of a launch monitor system 310 is shown. The launch monitor system 310 includes a frame 315 and a launch monitor 320 suspended from the frame 315. The frame 315 has a base 325 that contacts the ground and two, spaced arms 330 extending upwardly therefrom. The space between the arms 330 allows the launch monitor 320 to be received therebetween. The free ends of the arms 330 define bores for receiving fasteners 335 for securing a horizontally extending rod 340 thereto. The rod 340 defines a longitudinally extending pivot axis P. The frame 315 is formed of aluminum, cast urethane, or the like. The rod 340 is formed of aluminum or another metal.

The launch monitor 320 is similar to that shown in FIG. 16, and is for use with a separate calibration fixture (like fixture 170 shown in FIG. 7). A top surface 345 of the housing of launch monitor 320 includes a bracket 350 coupled thereto. The bracket 350 can be integrally formed with the housing of plastic or formed separately from the housing and connected thereto. The bracket 350 includes two spaced arms 355*a* and 355*b*. In another embodiment, the bracket 350 can have any number of arms from one or more. One of the arms has a level 360 connected to the upper surface thereof such as by glue. Liquid L within the level can move with respect to the pivot axis P. The free ends of the arms 355*a* and 355*b* define bores for receiving conventional bearings (not shown) and the rod 340. The bearings aid in rotatably connecting the rod 340 to the arms 355*a* and *b*. Preferably, the level 360 is a bubble or spirit level commercially available from McMaster Carr of Atlanta, Ga., under part number 2201A63.

The launch monitor 320 further includes a first end 365 on one side of the pivot axis P and a second end 370 on the other side of the pivot axis P. The pivot axis is aligned with the center of the monitor. The bottom surface of the launch monitor is suspended above the base 325 by a distance, designated d. The pivotal coupling of the launch monitor 320 to the frame 315 allows the ends 365 and 370 of the launch monitor to move with respect to the base 325, as illustrated by the arrows A.

During use, the frame 315 is placed on the ground, and a calibration fixture 170 (as shown in FIG. 7) is disposed in front of the monitor with the aid of the distance calibrators 160 (as shown in FIG. 7). The pivotal coupling of the launch monitor 320 to the frame 315 allows the ends 365 and 370 to move so that the launch monitor pivots about the axis P until the launch monitor is level. The level state of the monitor is indicated by the liquid L in the level 360. As a result, the launch monitor is self-leveling.

Figure 22:
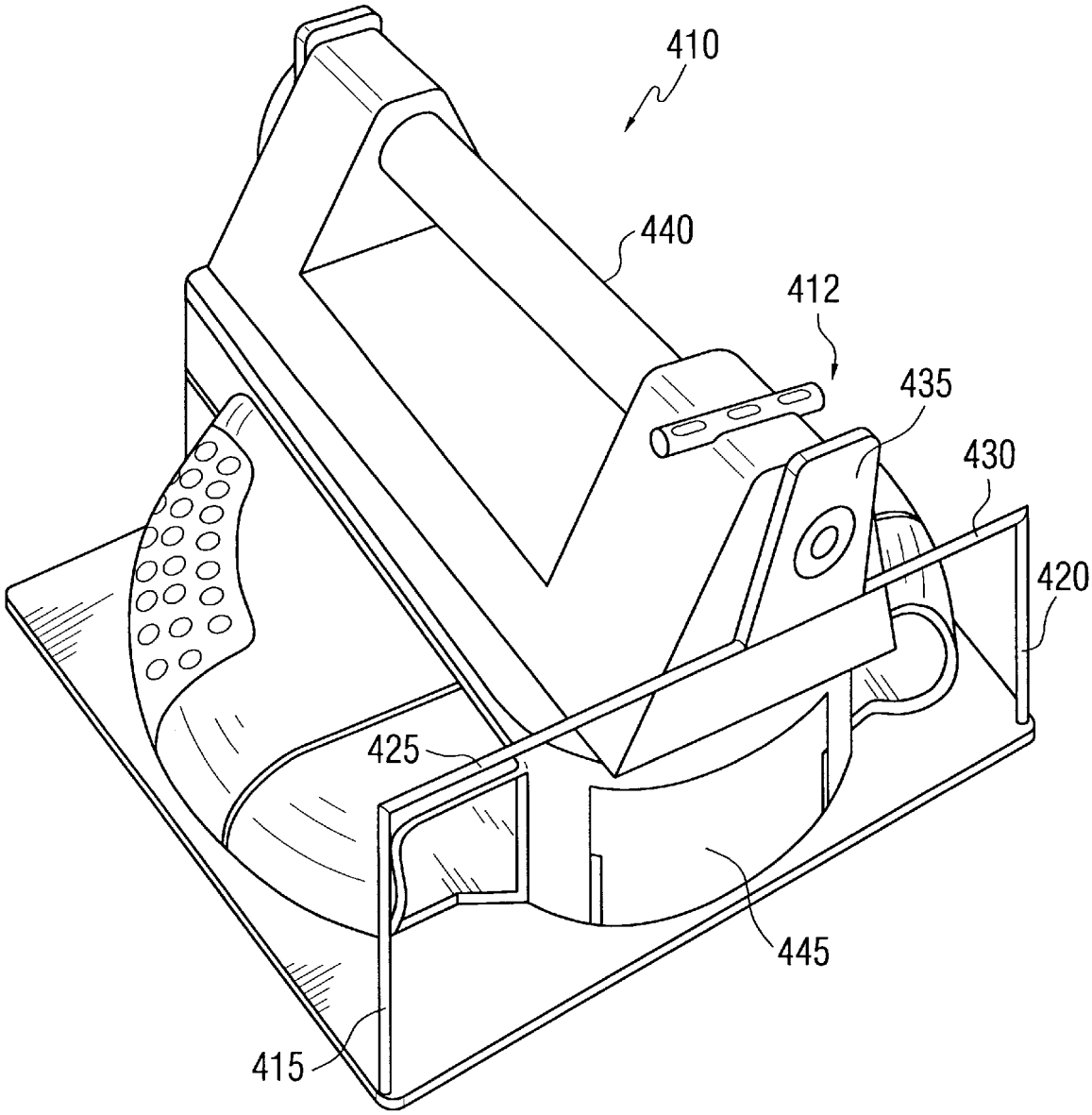
FIG. 22 is a perspective view of a self-leveling, fifth embodiment of the launch monitor of the present invention.

Referring to FIG. 22, a fifth embodiment of a launch monitor system 410 is shown. The system 410 is similar to the launch monitor 210 shown in FIG. 16; however it includes a frame 412 for pivotally suspending the launch monitor therefrom. The frame 412 is similar to the frame 315 shown in FIG. 21. A front arm of the frame is formed of several members. The front arm is formed of two vertical members 415, 420 connected to two horizontal members 425, 430 and a central vertical member 435. The member 435 is connected to the members 425 and 430 and rod 440. The configuration of the front arm allows the integral calibration fixture 445 to extend and retract from the launch monitor system 410.

While the above invention has been described with reference to certain preferred embodiments, it should be kept in mind that the scope of the present invention is not limited to these embodiments. For example, the self-leveling launch monitor may not include the base but rather two arms that are inserted directly into the ground. The embodiments above can also be modified so that some features of one embodiment are used with the features of another embodiment. One skilled in the art may find variations of these preferred embodiments which, nevertheless, fall within the spirit of the present invention, whose scope is defined by the claims set forth below.

We claim:

1. A launch monitor system for measuring flight characteristics of an object moving in a predetermined field-of-view, the system comprising:

a support structure;

a lighting unit disposed on the support structure and directing light into the predetermined field-of-view;

a first camera unit disposed on the support structure and pointed toward the predetermined field-of-view; and a calibration assembly including a calibration fixture; and at least one telescoping member having a first end coupled to the support structure and a second end contactable with the calibration fixture, wherein the telescoping member has an extended position placing the calibration fixture in the field-of-view of the first camera unit;

wherein the calibration fixture is coupled to the second end of the telescoping member, and the telescoping member has a retracted position where the calibration fixture is out of the field-of-view of the first camera unit; and wherein the calibration fixture further includes a back wall and first, second and third walls spaced from one another and extending outwardly from the back wall, and two legs, each leg being pivotally connected to the first and second walls.

2. The launch monitor system of claim 1, wherein the calibration fixture further includes contrasting markings in at least two different planes.

3. The launch monitor system of claim 2, wherein the contrasting markings are reflective markings.

4. The launch monitor system of claim 2, wherein the contrasting markings are painted markings.

5. The launch monitor system of claim 2, wherein the calibration fixture further includes contrasting markings in at least three different planes.

6. The launch monitor system of claim 1, further including a second camera unit disposed on the support structure and pointed toward the predetermined field-of-view, and the telescoping member is disposed between the first camera unit and the second camera unit.

7. The launch monitor system of claim 6, further including a computer with at least one algorithm, each camera for taking at least one image of the calibration fixture, wherein the computer converts each image into calibration data.

8. A launch monitor system for measuring flight characteristics of an object moving in a predetermined field-of-view, the system comprising:

a support structure;

a lighting unit disposed on the support structure and directing light into the predetermined field-of-view;

a first camera unit disposed on the support structure and pointed toward the predetermined field-of-view; and a calibration assembly including:

a calibration fixture; and at least one telescoping member having a first end coupled to the support structure and a second end contactable with the calibration fixture, wherein the telescoping member has an extended position placing the calibration fixture in the field-of-view of the first camera unit;

wherein the calibration fixture includes contrasting markings in at least three different planes; and wherein the calibration fixture further includes a back wall and first, second and third walls spaced from one another and extending outwardly from the back wall.

9. The launch monitor system of claim 8, wherein the first and second walls are disposed on either side of the third wall, the first and second walls have a first length and the third wall has a second length different from the first length.

10. The launch monitor system of claim 9, wherein the first length is less than the second length.

11. The launch monitor system of claim 9, wherein the first length is greater than the second length.

12. The launch monitor system of claim 8, wherein the contrasting markings are disposed on the free ends of the first, second, and third walls and a surface of the back wall.

13. The launch monitor system of claim 12, wherein the contrasting areas are retro-reflective dots.

14. The launch monitor system of claim 13, wherein one row is disposed on the free end of each first, second, and third wall, and the remaining two rows are disposed on the back wall on either side of the third wall.

* * * * *